US011402145B1

(12) United States Patent
Wohlers et al.

(10) Patent No.: US 11,402,145 B1
(45) **Date of Patent: *Aug. 2, 2022**

(54) SPLIT AIR FLOW SYSTEM

(71) Applicant: Sub-Zero Group, Inc., Madison, WI (US)

(72) Inventors: Elizabeth Wohlers, Stoughton, WI (US); Brant David Springer, Janesville, WI (US)

(73) Assignee: Sub-Zero Group, Inc., Madison, WI (US)

( * ) Notice: Subject to any disclaimer, the term of this patent is extended or adjusted under 35 U.S.C. 154(b) by 133 days.

This patent is subject to a terminal disclaimer.

(21) Appl. No.: 16/828,152

(22) Filed: Mar. 24, 2020

(51) Int. Cl.

| | |
|---|---|
| ***F25D 17/06*** | (2006.01) |
| ***F25D 11/02*** | (2006.01) |
| ***F25D 25/02*** | (2006.01) |
| ***F25D 17/04*** | (2006.01) |
| ***F25D 17/08*** | (2006.01) |

(52) U.S. Cl.
CPC ..... *F25D 17/065* (2013.01); *F25D 11/02* (2013.01); *F25D 17/045* (2013.01); *F25D 17/067* (2013.01); *F25D 17/08* (2013.01); *F25D 25/025* (2013.01); *F25D 2317/067* (2013.01); *F25D 2317/0682* (2013.01)

(58) Field of Classification Search
CPC ..... F25D 11/022; F25D 11/02; F25D 17/065; F25D 2700/121; F25D 17/045; F25D 17/067; F25D 17/08; F25D 25/025; F25D 2317/067; F25D 2317/068
See application file for complete search history.

(56) References Cited

U.S. PATENT DOCUMENTS 4,058,989 A * 11/1977 Horvay ..... F25D 11/02 62/256
4,416,119 A 11/1983 Wilson et al.
4,722,200 A 2/1988 Frohbieter
(Continued)

FOREIGN PATENT DOCUMENTS

CN 110145913 A * 8/2019
EP 0218560 4/1987
KR 100757444 B1 * 9/2007

OTHER PUBLICATIONS

Translated_CN-110145913-A (Year: 2019).*
GE Appliances from products website for GE Energy Star 25.4 Cu. Ft. Side-By-Side Refrigerator, printed Sep. 4, 2018.

*Primary Examiner* — Elizabeth J Martin
*Assistant Examiner* — Samba Gaye
(74) *Attorney, Agent, or Firm* — Bell & Manning, LLC

(57) ABSTRACT

A refrigerator includes an evaporator, a first fan, a first duct, a second fan, a second duct, and a plate. The first duct is mounted between the evaporator and the first fan. The first fan moves air from the first duct into a first zone. The second fan moves air from the second duct into a second zone. The plate is mounted between the evaporator and the second duct. The plate includes a plate aperture wall that defines a duct aperture formed through the plate. A first aperture of the second duct is adjacent the second fan. A second aperture of the second duct is positioned to encompass the duct aperture. A center of the duct aperture is positioned a distance from a center of the evaporator measured in a first direction. The distance is between 0% and 40% of a total length of the evaporator in the first direction.

20 Claims, 27 Drawing Sheets

(56) References Cited

U.S. PATENT DOCUMENTS

| | | | | |
|---|---|---|---|---|
| 4,732,014 | A | 3/1988 | Frohbieter | |
| 4,876,860 | A | 10/1989 | Negishi | |
| 5,255,530 | A | 10/1993 | Janke | |
| 5,758,512 | A | 6/1998 | Peterson et al. | |
| 5,899,083 | A | 5/1999 | Peterson et al. | |
| 6,094,931 | A | 8/2000 | Jeong | |
| 6,170,276 | B1 | 1/2001 | Mandel et al. | |
| 6,213,731 | B1 | 4/2001 | Doepker et al. | |
| 6,223,553 | B1 | 5/2001 | Albert et al. | |
| 6,655,164 | B2 | 12/2003 | Rogstam | |
| 6,672,090 | B1 | 1/2004 | Healy et al. | |
| 6,725,680 | B1 * | 4/2004 | Schenk | F25D 11/02 62/186 |
| 6,931,867 | B2 | 8/2005 | Healy et al. | |
| 7,127,904 | B2 | 10/2006 | Schmid | |
| RE40,257 | E | 4/2008 | Doepker et al. | |
| 7,665,327 | B2 | 2/2010 | Tunzi | |
| 7,942,012 | B2 | 5/2011 | Ritchie et al. | |
| 8,082,746 | B2 | 12/2011 | Yamanaka et al. | |
| 8,833,089 | B2 | 9/2014 | Tandou et al. | |
| 9,010,145 | B2 | 4/2015 | Lim et al. | |
| 9,733,008 | B2 | 8/2017 | Koppenhaver | |
| 10,317,123 | B1 | 6/2019 | Wohlers | |
| 11,131,496 | B2 * | 9/2021 | Fei | F25D 17/045 |
| 2008/0134708 | A1 | 6/2008 | Lee et al. | |
| 2011/0011106 | A1 | 1/2011 | Ahn et al. | |
| 2011/0209490 | A1 | 9/2011 | Mijanovic et al. | |
| 2013/0312437 | A1 | 11/2013 | Davies et al. | |
| 2017/0292766 | A1 * | 10/2017 | Lee | F25D 17/065 |
| 2018/0266736 | A1 * | 9/2018 | Kim | F25B 21/04 |
| 2018/0340726 | A1 * | 11/2018 | Cha | F25D 17/065 |
| 2021/0055032 | A1 * | 2/2021 | Vijayan | F25D 11/02 |

* cited by examiner

SPLIT AIR FLOW SYSTEM

BACKGROUND

Refrigerators can be divided into multiple cooling zones that can be controlled independently over the same or different temperature ranges. For example, a refrigerator may include a plurality of refrigerated zones that are designed to operate between 34° Fahrenheit (F) and 42° F. and one or more freezer zones that are designed to operate below 32° F.

SUMMARY

In an example embodiment, a refrigerator is provided. The refrigerator includes, but is not limited to, an evaporator, a refrigerator controller, a compartment, a first temperature sensor, a second temperature sensor, a first fan, a first duct, a second fan, a second duct, a return duct, and a plate. The compartment includes, but is not limited to, a plurality of walls, wherein at least one of the plurality of walls is configured to be moved with respect to remaining walls of the plurality of walls to provide access to a cavity defined by the remaining walls. The first temperature sensor is configured to measure a first temperature value of air in a first zone within the compartment and to send the measured first temperature value to the refrigerator controller. The second temperature sensor is configured to measure a second temperature value of air in a second zone within the compartment and to send the measured second temperature value to the refrigerator controller. The first duct is mounted between the evaporator and the first fan. The first fan is configured to receive air from the first duct and to move the received air into the first zone when on. The second duct is mounted between the evaporator and the second fan and includes, but is not limited to, a duct wall that forms a first aperture and a second aperture. The second fan is configured to receive second air from the evaporator through the second duct and to move the received second air into the second zone when on. The return duct is mounted at least partially between the first zone or the second zone and the evaporator. The plate is mounted between the evaporator and the second duct. The plate includes, but is not limited to, a plate aperture wall that defines a duct aperture formed through the plate. The first aperture of the second duct is adjacent the second fan. The second aperture of the second duct is positioned to encompass the duct aperture. A center of the duct aperture is positioned a distance from a center of the evaporator measured in a first direction. The distance is between 0% and 40% of a total length of the evaporator in the first direction.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 2:
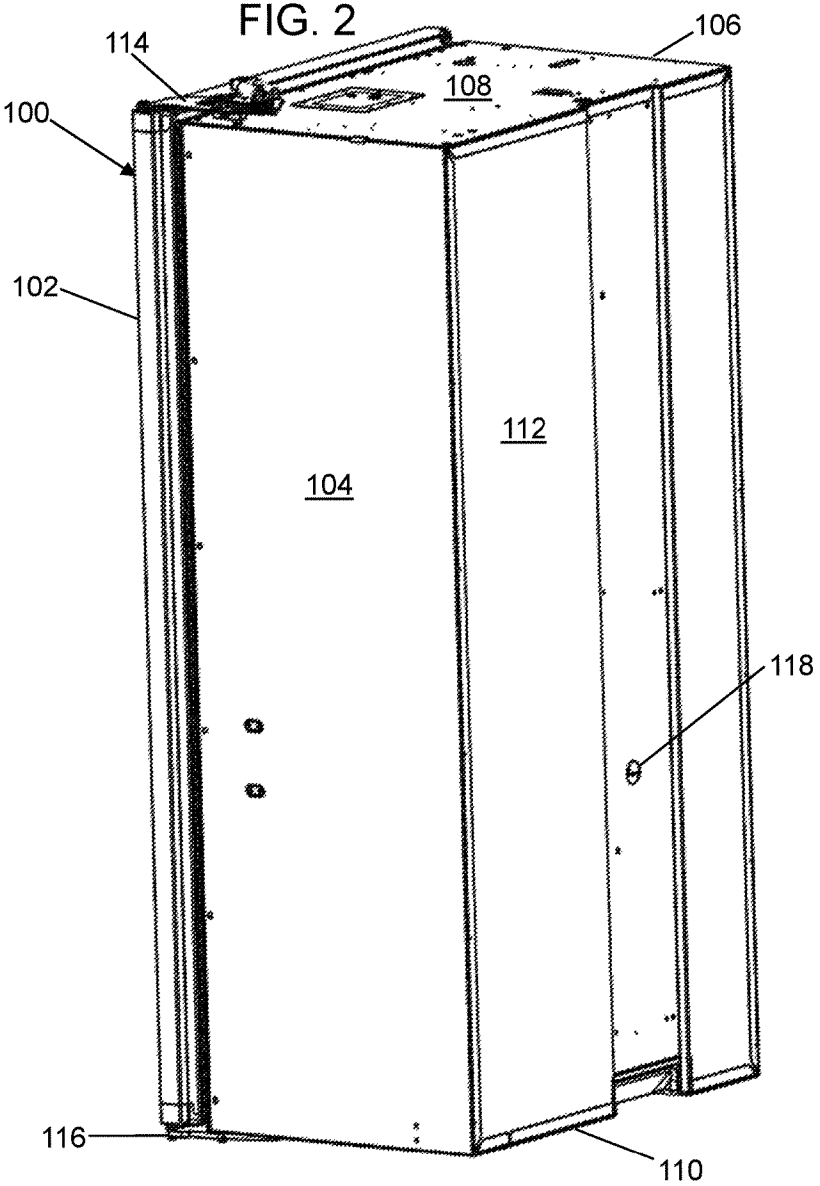
FIG. 2 depicts a right, back, perspective view of the refrigerator of FIG. 1 in accordance with an illustrative embodiment.
Figure 1:
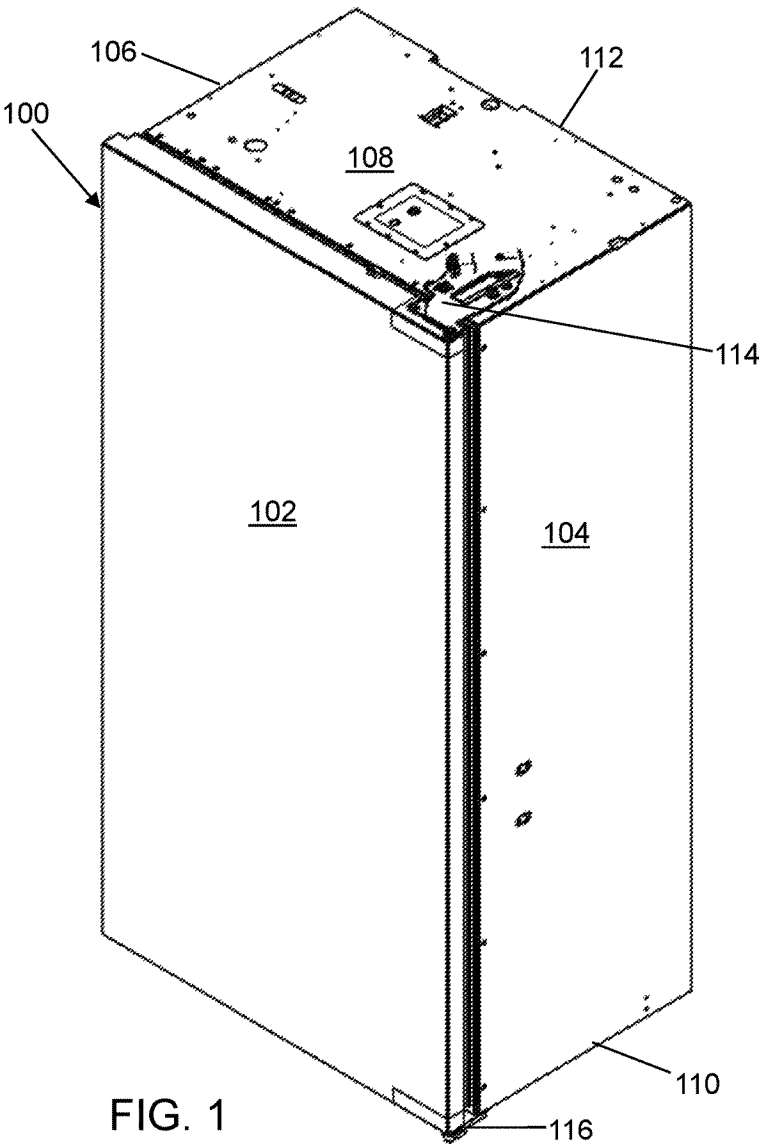
FIG. 1 depicts a right, front, perspective view of a refrigerator in accordance with an illustrative embodiment.

Referring to FIG. 1, a right, front, perspective view of a refrigerator 100 is shown in accordance with an illustrative embodiment. Referring to FIG. 2, a right, back, perspective view of refrigerator 100 is shown in accordance with an illustrative embodiment. Refrigerator 100 may include one or more compartments where each compartment may include one or more cooling zones. Separate compartments are separately enclosed with respect to each other; whereas, separate cooling zones exist within the same compartment as defined by a plurality of walls. Separate compartments may also be sealed with respect to each other though ducts may provide air flow between two or more compartments in some embodiments to allow joint use of some cooling components.

In the illustrative embodiment of FIG. 1, refrigerator 100 may include a door 102, a right wall 104, a left wall 106, a top wall 108, a bottom wall 110, and a back wall 112 that define an interior cavity within which items can be placed for cooling. A top hinge 114 and a bottom hinge 116 mount door 102 to top wall 108 and to bottom wall 110, respectively, so that door 102 can be rotated to an open position to allow access to the interior cavity.

A drain port 118 may be formed through back wall 112 to allow condensation to drip exterior of a cabinet 700 (shown referring to FIG. 7) formed by right wall 104, left wall 106, top wall 108, bottom wall 110, and back wall 112. In an alternative embodiment, an additional one or more wall plates may be used to cover an exterior of any of door 102, right wall 104, left wall 106, top wall 108, bottom wall 110, and back wall 112 to improve an aesthetic appearance of refrigerator 100. In the illustrative embodiment of FIG. 1, refrigerator 100 includes a single compartment defined by cabinet 700 and door 102.

The components of refrigerator 100 including cabinet 700 and door 102 may be formed of one or more materials, such as metal, glass, and/or plastic having a sufficient strength and rigidity to provide the illustrated and/or described function. Each wall may be formed of one or more plates. For each wall comprised of a plurality of plates, the plurality of plates may be mounted to each other using various fasteners or fastening methods with electrical wiring, ducts, tubing, sensors, and/or insulation possibly mounted between the plurality of plates. Various fasteners or fastening methods such as screws, rivets, soldering, molding, etc. further may be used to mount various components described herein to each other.

Figure 4:
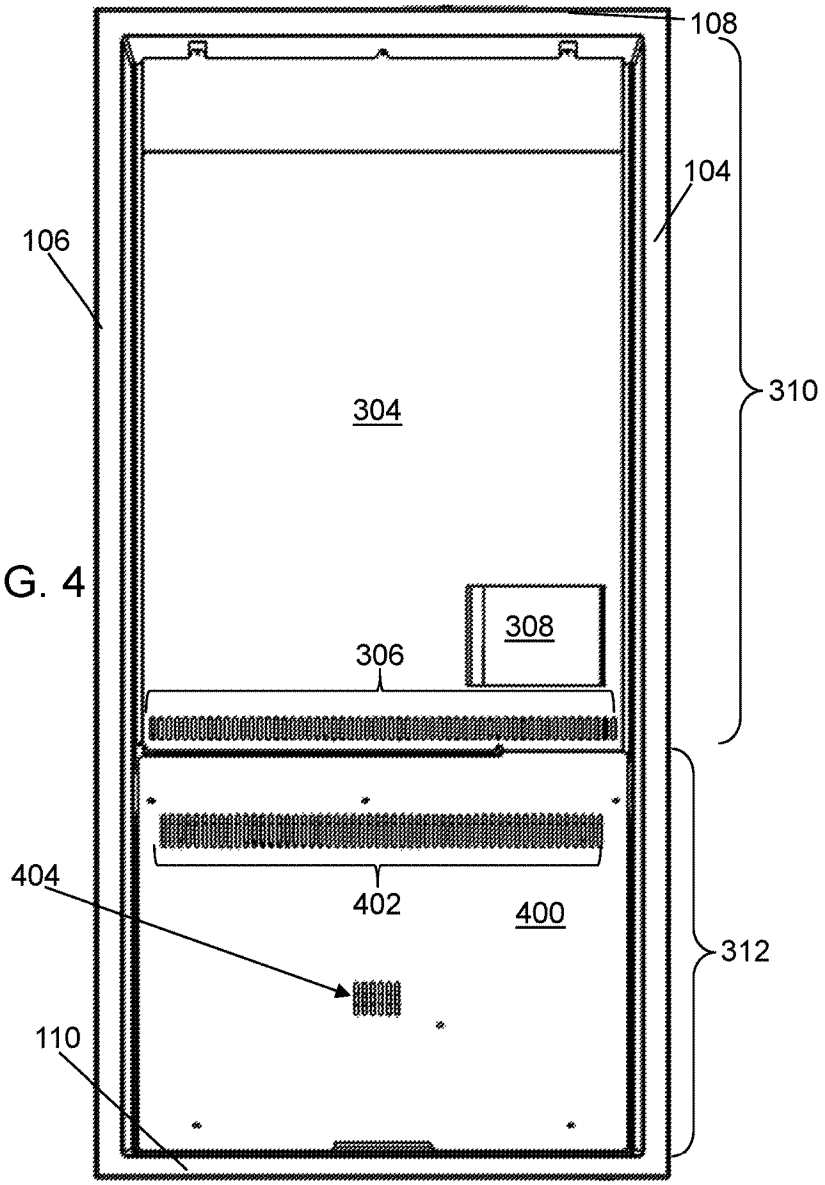
FIG. 4 depicts a front view of the refrigerator of FIG. 1 with the door and a drawer stack removed in accordance with an illustrative embodiment.
Figure 3:
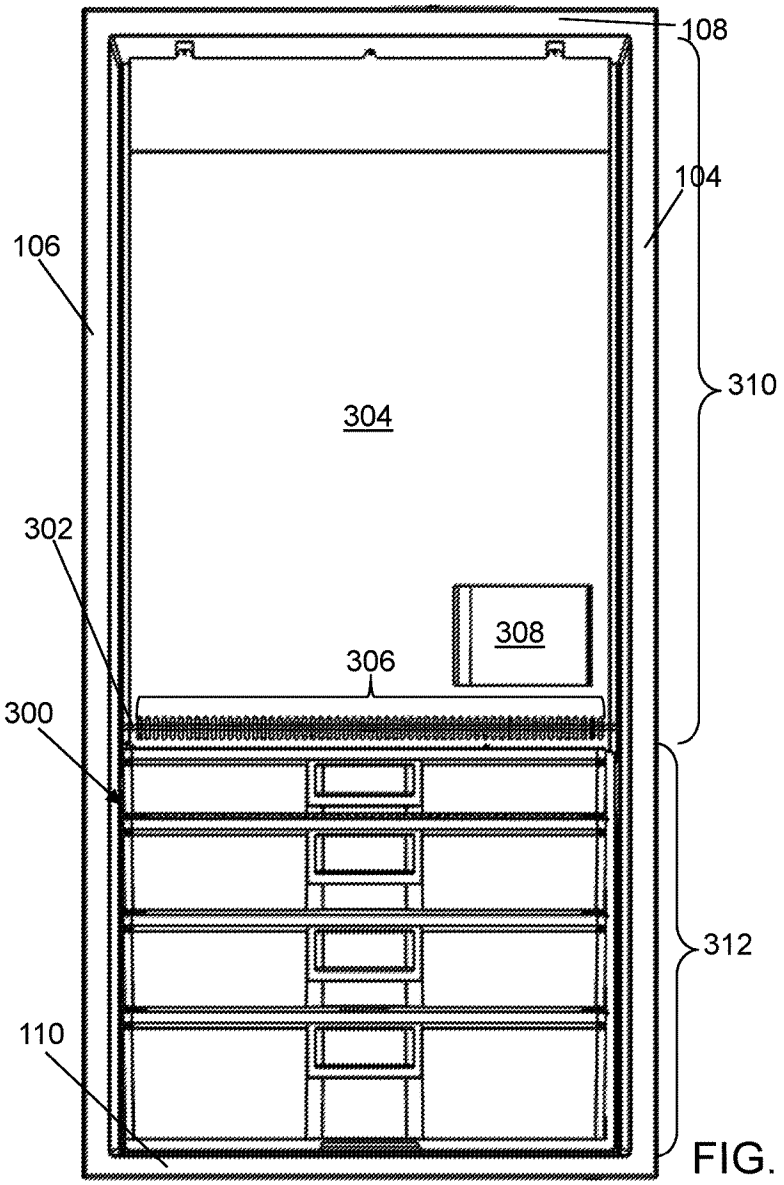
FIG. 3 depicts a front view of the refrigerator of FIG. 1 with a door removed in accordance with an illustrative embodiment.

Referring to FIG. 3, a front view of refrigerator 100 with door 102 removed is shown in accordance with an illustrative embodiment. Referring to FIG. 4, a front view of refrigerator 100 with door 102 and a drawer stack 300 removed is shown in accordance with an illustrative embodiment. Drawer stack 300 and a shelf 302 may be mounted within cabinet 700. The one or more shelves, such as shelf 302, drawers, or other receptacles, such as drawer stack 300, may be formed of one or more materials, such as metal, glass, and/or plastic having a sufficient strength and rigidity to support food items or other items stored in refrigerator 100. Though not shown, one or more additional drawers and/or shelves may be mounted within cabinet 700 above drawer stack 300. A top vent plate 304 is part of back wall 112 and is mounted above drawer stack 300. A plurality of intake vents 306 are formed as apertures through top vent plate 304. The plurality of intake vents 306 may provide an intake for air flow from within cabinet 700 to an evaporator 704 (shown referring to FIG. 7).

An air purifier cover plate 308 may cover an opening in top vent plate 304 that provides access to an air filter (not shown). An air filter housing may be mounted behind air purifier cover plate 308. An air filter may be mounted within the air filter housing to filter air passing therethrough. For example, in the illustrative embodiment, the air filter is mounted above a portion of the plurality of intake vents 306 to filter the air passing therethrough.

In the illustrative embodiment, an interior of back wall 112 is split into top vent plate 304 and a bottom vent plate 400 though the interior of back wall 112 may include one or more plates in various arrangements relative to each other that cover a back of cabinet 700. Cabinet 700 defines a first zone 310 generally associated with a top two-thirds of cabinet 700 and a second zone 312 generally associated with drawer stack 300 though cabinet 700 may define a greater number of zones in alternative embodiments.

A second zone top plurality of vents 402 and a second zone middle plurality of vents 404 are formed as apertures through bottom vent plate 400. The second zone top plurality of vents 402 and the second zone middle plurality of vents 404 may provide an outtake for air flow from evaporator 704 into second zone 312 of cabinet 700. The air flow from the second zone top plurality of vents 402 and the second zone middle plurality of vents 404 circulates around and through drawer stack 300.

Though not shown, one or more top vents formed in an interior surface of top wall 108 or a top of top vent plate 304 provide air flow from evaporator 704 into first zone 310 of cabinet 700. The air circulated into cabinet 700 from evaporator 704 is drawn back through the plurality of intake vents 306 to be cooled again by evaporator 704 when cooling is needed in either or both of first zone 310 or second zone 312. In the illustrative embodiment, evaporator 704 is mounted in a continuous duct that receives air at a bottom through the plurality of intake vents 306 and exhausts air at a top through the one or more top vents. A bottom of the continuous duct may be defined by a location of the plurality of intake vents 306, and a top of the continuous duct may be defined by a location of a first fan 3728 (shown referring to FIG. 37).

The single compartment may provide a freezer zone or a refrigerated zone. For example, in the illustrative embodiment, the single compartment includes first zone 310 and second zone 312 that are both refrigerator zones designed to operate between 34 degrees Fahrenheit (° F.) and 42° F., for example, based on a selection using a first temperature control 3718 (shown referring to FIG. 37) and a second temperature control 3722 (shown referring to FIG. 37). In alternative embodiments, first temperature control 3718 and second temperature control 3722 may be set to any temperature or within any temperature range. As understood by a person of skill in the art, a temperature control allows a user of refrigerator 100 to set a desired temperature value to maintain in a zone or compartment of refrigerator 100. The temperature control may be implemented using a dial, knob, touch display, switch, etc. to allow the user to increase or decrease the temperature set value or to enter a specific temperature set value.

In general, a temperature of each refrigerated zone is maintained at an adequate temperature to preserve fresh food. In alternative embodiments, refrigerator 100 may include a fewer or a greater number of compartments and/or cooling zones arranged vertically and/or horizontally with respect to each other. For example, refrigerator 100 may include one or more compartments to the left or the right of the single compartment or below or above the single compartment. A wall that separates a pair of compartments may or may not be insulated and/or sealed. Additionally, whether insulated and/or sealed, one or more ducts may provide joint air flow between two or more compartments.

Figure 37:
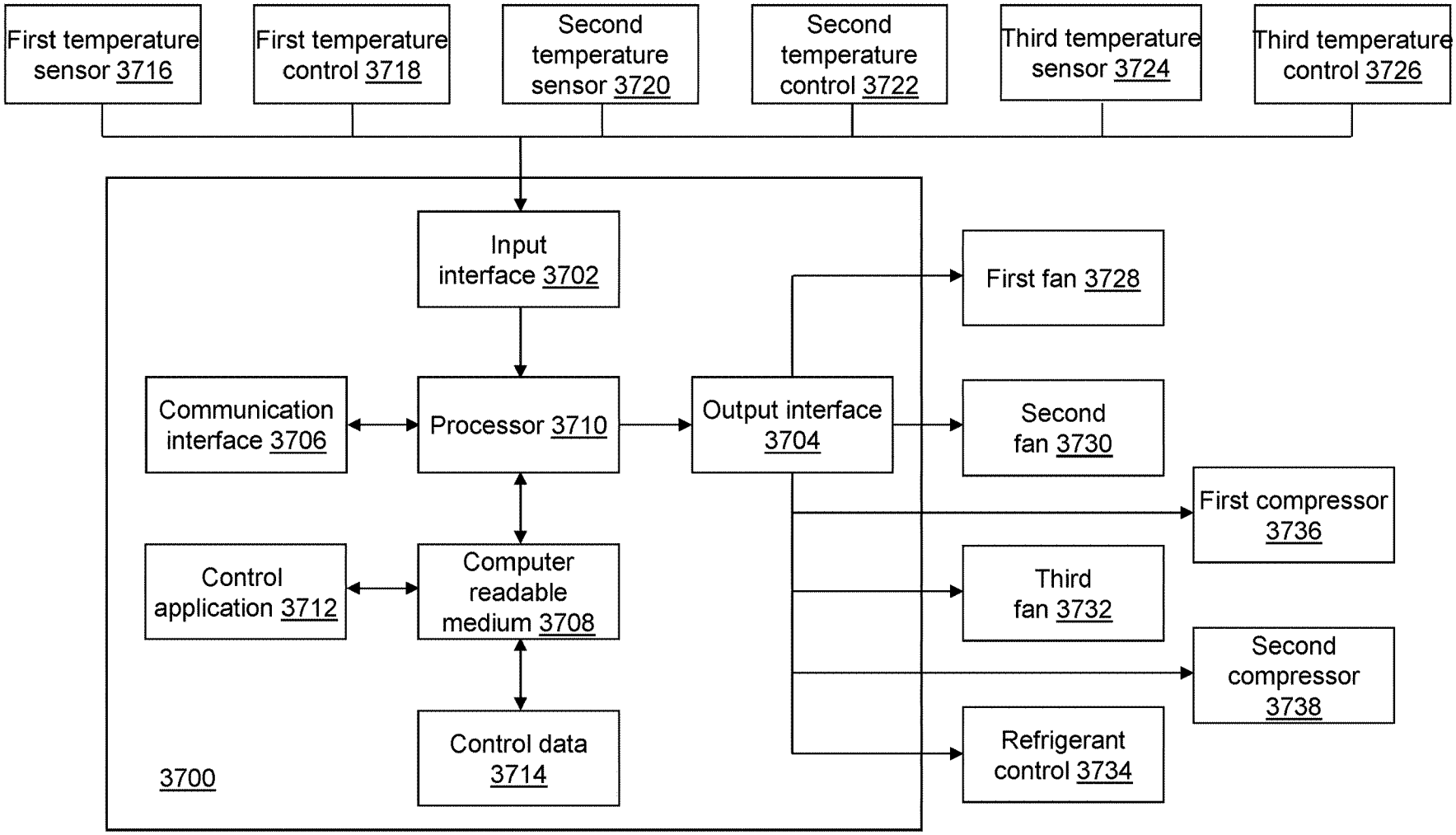
FIG. 37 depicts a block diagram of a refrigerator controller of the refrigerator of FIG. 1 or of the second refrigerator of FIG. 22 in accordance with an illustrative embodiment.

Each compartment may include and be defined by an interior of a plurality of walls, a compartment access structure configured to provide access to an enclosed space defined by the plurality of walls and the compartment access structure, and a temperature sensor configured to measure a temperature value of air in the enclosed space or a portion of the enclosed space and to send the measured temperature value to a refrigerator controller 3700 (shown referring to FIG. 37). For example, a first temperature sensor 3716 (shown referring to FIG. 37) may measure a current temperature within first zone 310 of cabinet 700 and a second temperature sensor 3720 (shown referring to FIG. 37) may measure a current temperature within second zone 312 of cabinet 700. First temperature sensor 3716 and second temperature sensor 3720 may be positioned adjacent a wall of cabinet 700. For illustration, first temperature sensor 3716 and second temperature sensor 3720 may each be a thermistor electrically connected either by wire or wirelessly to refrigerator controller 3700 to provide the measured temperature periodically, continuously, when requested, etc.

Figure 5:
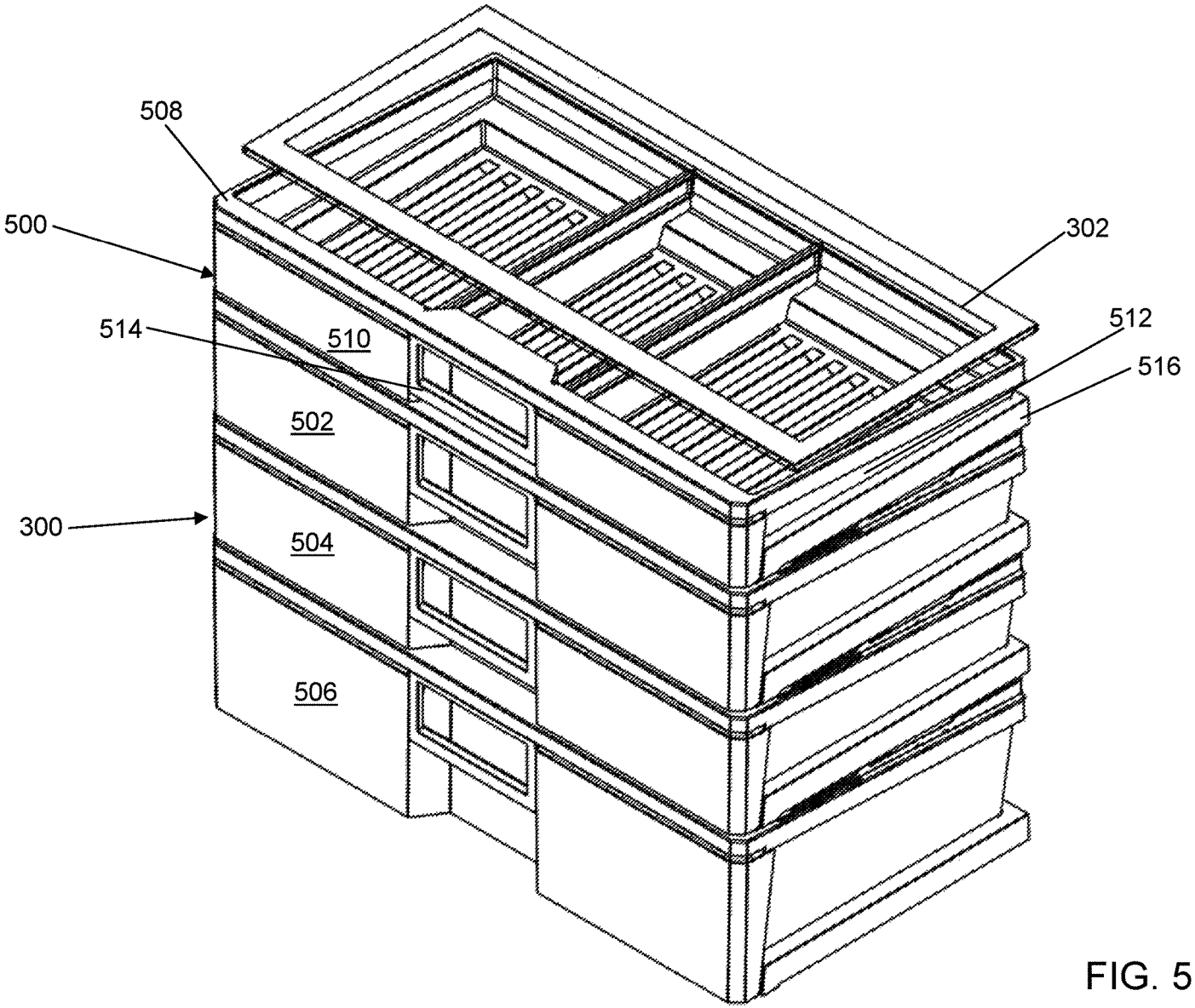
FIG. 5 depicts a right, front, perspective of the drawer stack of FIG. 4 in accordance with an illustrative embodiment.
Figure 6:
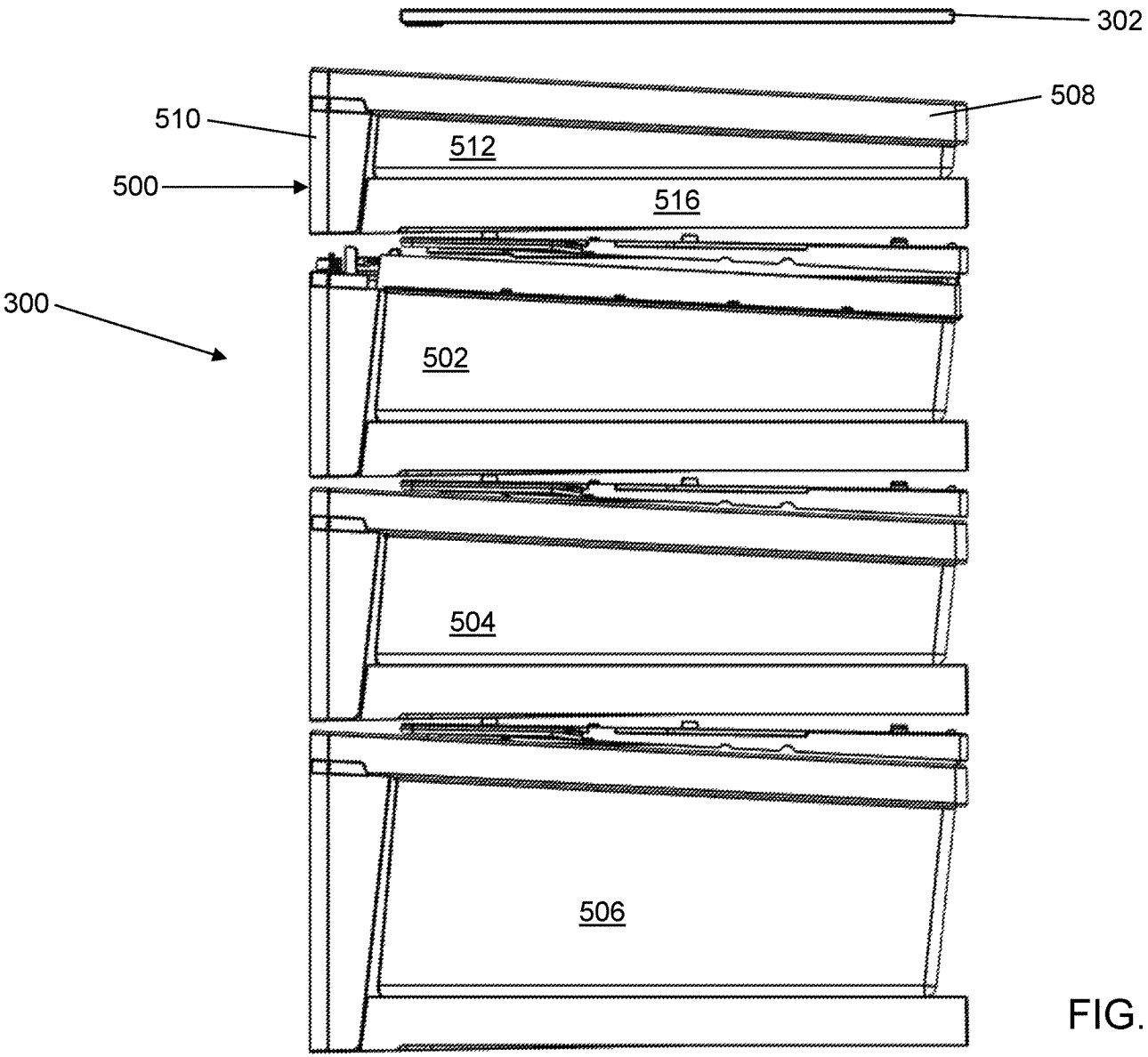
FIG. 6 depicts a right-side view of the drawer stack of FIG. 5 in accordance with an illustrative embodiment.

Referring to FIG. 5, a right, front, perspective view of drawer stack 300 is shown in accordance with an illustrative embodiment. Referring to FIG. 6, a right-side view of drawer stack 300 is shown in accordance with an illustrative embodiment. In the illustrative embodiment, drawer stack 300 includes a first drawer 500, a second drawer 502, a third drawer 504, and a fourth drawer 506 stacked vertically below shelf 302. Each drawer may be enclosed separately and opened so that the user can access the content of each drawer. In the illustrative embodiment, second drawer 502, third drawer 504, and fourth drawer 506 are sealed with glass and gaskets for food preservation purposes though each drawer may be closed and sealed or unsealed or may be open based on the desired food preservation purposes for the respective drawer.

For example, first drawer 500 may include a drawer cover 508, a drawer door 510, a drawer sidewall 512, and a drawer bottom wall (not shown). Drawer door 510, drawer sidewall 512, and drawer bottom wall form an enclosure that is open on top. A drawer handle 514 may be formed in or mounted to drawer door 510 so that the user can easily open first drawer 500 by sliding drawer door 510 forward out from under drawer cover 508 on a drawer tray 516 that remains stationary though other types of drawers may be used with other mounting mechanisms in alternative embodiments as understood by a person of skill in the art.

Drawer tray 516 may be mounted to one or more walls of cabinet 700 using various mounting mechanisms. In alternative embodiments, drawer stack 300 may include a greater or a fewer number of drawers that may be arranged vertically and/or horizontally with respect to each other. As a result, second zone 312 may be larger or smaller than that shown in the illustrative embodiments. Second zone 312 further may not be rectangular or square but form a different polygonal shape based on a location of the drawers and vents such as second zone top plurality of vents 402 and second zone middle plurality of vents 404.

Figure 7:
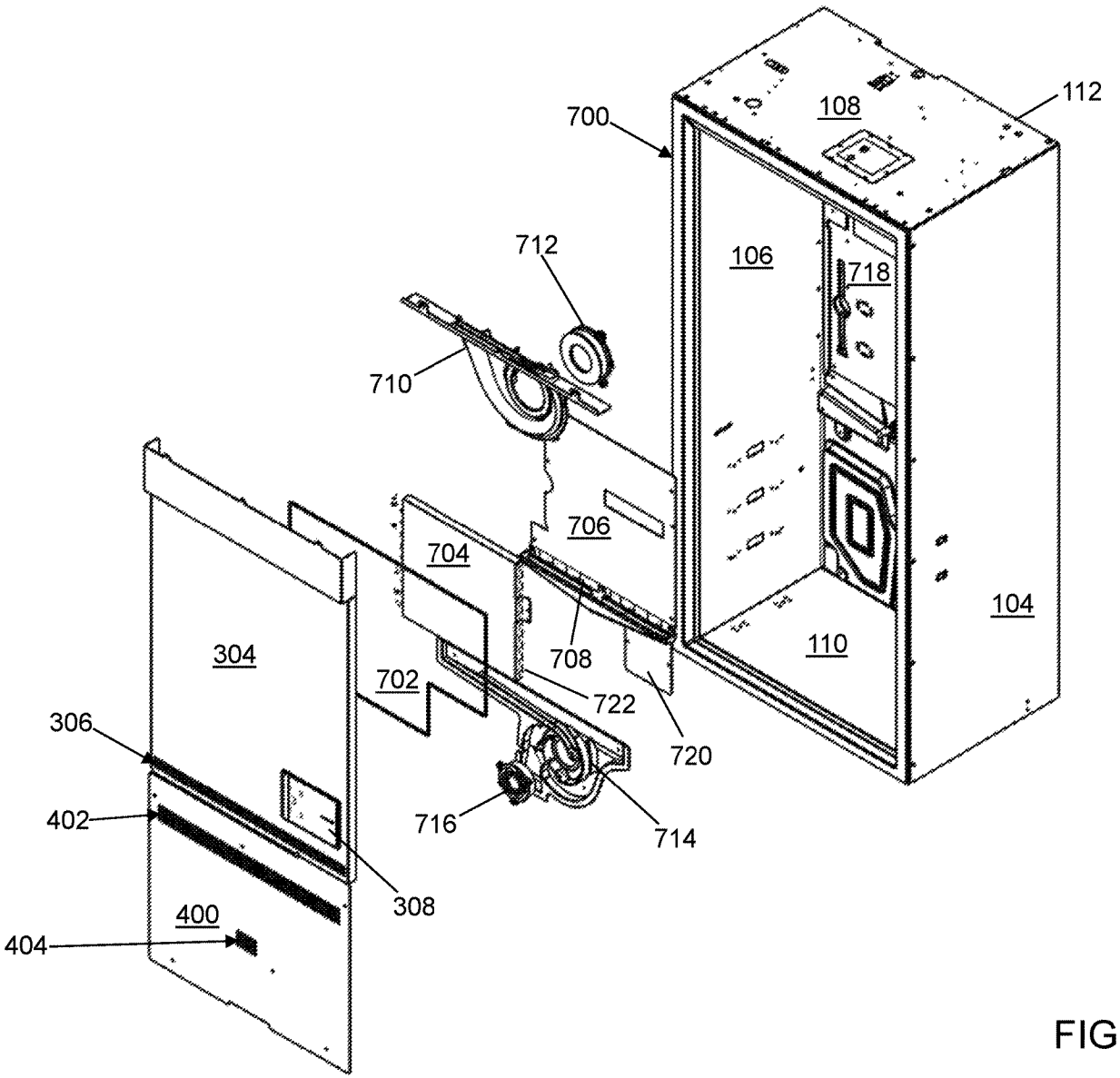
FIG. 7 depicts a right, front, perspective, exploded view of the refrigerator of FIG. 1 with the door and the drawer stack removed in accordance with an illustrative embodiment.
Figure 8:
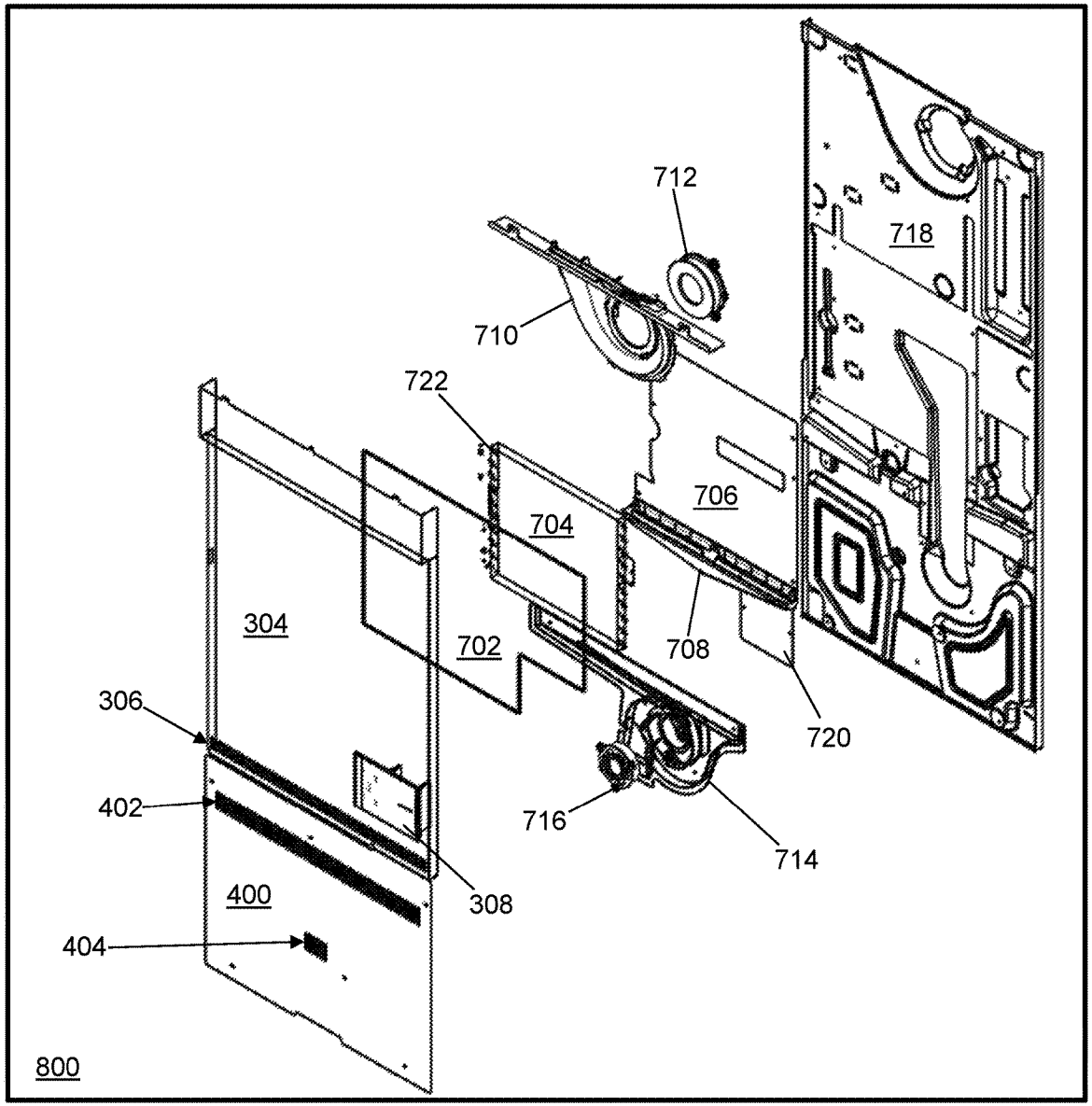
FIG. 8 depicts a right, front, perspective, exploded view of an air flow system of the refrigerator of FIG. 1 in accordance with an illustrative embodiment.

Referring to FIG. 7, a right, front, perspective, exploded view is shown of refrigerator 100 with door 102 and drawer stack 300 removed in accordance with an illustrative embodiment. Referring to FIG. 8, a right, front, perspective, exploded view of an air flow system 800 of refrigerator 100 is shown in accordance with an illustrative embodiment. Air flow system 800 may include top vent plate 304, bottom vent plate 400, an evaporator front cover plate 702, evaporator 704, an evaporator back cover plate 706, a drain trough 708, a first fan shroud 710, a first fan housing 712, a second fan shroud 714, a second fan housing 716, a back liner 718, and a lower duct cover plate 720. Top vent plate 304, bottom vent plate 400, and back liner 718 form portions of back wall 112 though air flow system 800 may be included in other walls of cabinet 700 in alternative embodiments. The components of air flow system 800 may be formed of one or more materials, such as metal, glass, and/or plastic having a sufficient strength and rigidity to provide the illustrated and/or described function.

In the illustrative embodiment, evaporator front cover plate 702 is mounted between top vent plate 304 and evaporator 704, and evaporator back cover plate 706 is mounted between back liner 718 and evaporator 704. In an illustrative embodiment, evaporator front cover plate 702 is a panel that includes or is formed of an insulating material such as being formed of a foam material. Drain trough 708 is mounted below evaporator 704 to catch condensation from evaporator 704 and direct it out of back wall 112 using drain port 118 mounted within a drain aperture wall 1316 (shown referring to FIG. 13) formed through back liner 718.

For illustration, back liner 718 may be formed of a plastic material through a vacuum molding process, and top vent plate 304, bottom vent plate 400, evaporator front cover plate 702; evaporator back cover plate 706 may be formed of sheet metal; and first fan shroud 710 and second fan shroud 714 may be formed of a plastic material.

As understood by a person of skill in the art, evaporator 704 may include an evaporator coil 722 within which a refrigerant is changed from liquid form to gaseous form to cool air that flows around evaporator coil 722. A refrigerant control 3734 (shown referring to FIG. 37), such as an expansion valve, may be operated by refrigerator controller 3700 to open or close to allow the flow of the refrigerant. Additionally, a first compressor 3736 (shown referring to FIG. 37) may be operated by refrigerator controller 3700 to receive the refrigerant in its gaseous form from evaporator 704 and further increase a pressure of the refrigerant before the refrigerant is input to a condenser to convert the gas back into liquid form. Evaporator 704 may be of various types known to a person of skill in the art. First compressor 3736 may be a single or variable speed compressor of various types known to a person of skill in the art.

First fan housing 712 may include first fan 3728 that is mounted within first fan housing 712. A motor (not shown) that operates first fan 3728 at one or more fan speeds under control of refrigerator controller 3700 may also be mounted within first fan housing 712. First fan 3728 may be selected and mounted based on a size of first zone 310 and a direction of desired air flow into first zone 310 from evaporator 704. For example, first fan 3728 may be an axial flow fan, a centrifugal fan, a cross-flow fan, etc. First fan 3728 is mounted within first fan shroud 710 that further disperses air from evaporator 704 into first zone 310.

Similarly, second fan housing 716 may include a second fan 3730 (shown referring to FIG. 37) that is mounted within second fan housing 716. A motor (not shown) that operates second fan 3730 at one or more fan speeds under control of refrigerator controller 3700 may also be mounted within second fan housing 716. Second fan 3730 may be selected and mounted based on a size of second zone 312 and a direction of desired air flow into second zone 312 from evaporator 704. For example, second fan 3730 may be an axial flow fan, a centrifugal fan, a cross-flow fan, etc. Second fan 3730 is mounted within second fan shroud 714 that further disperses air from evaporator 704 into second zone 312.

Figure 10:
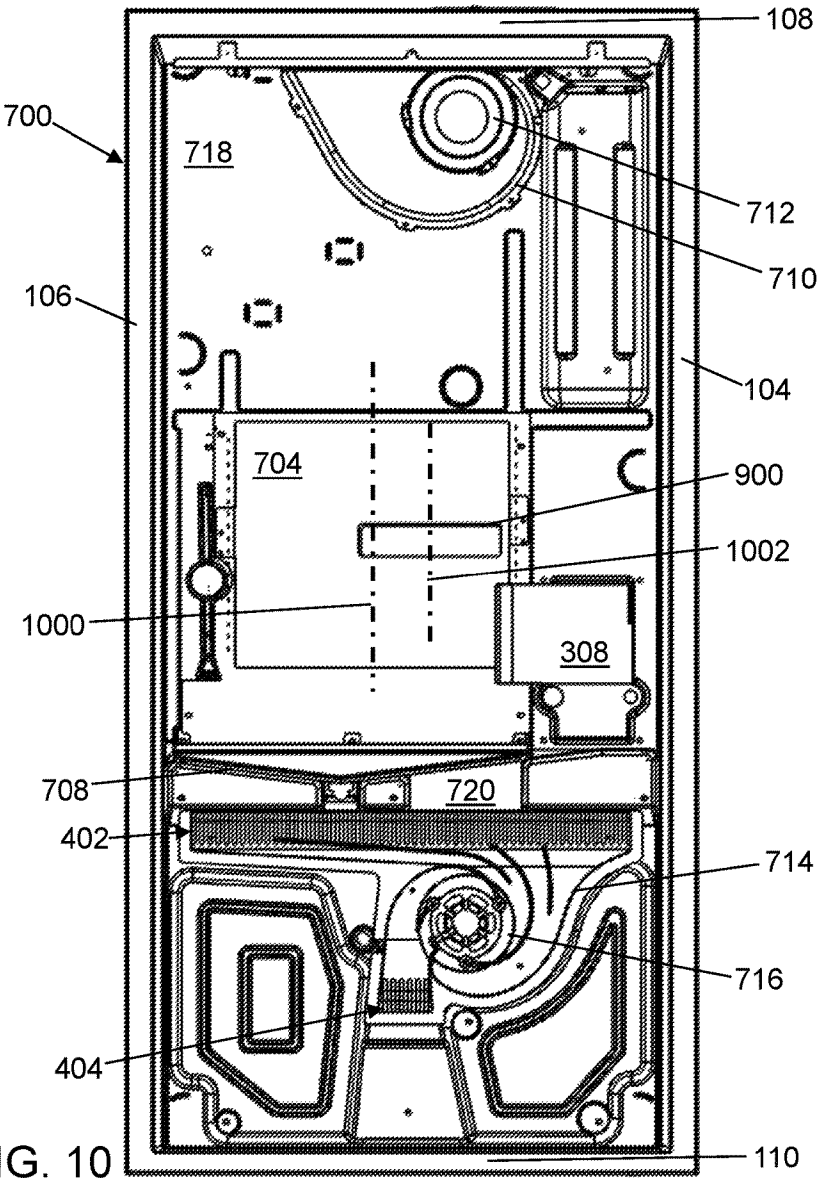
FIG. 10 depicts a front view of the refrigerator of FIG. 1 with the door, a plurality of first zone wall plates, and the drawer stack removed in accordance with an illustrative embodiment where the evaporator is shown transparent.
Figure 9:
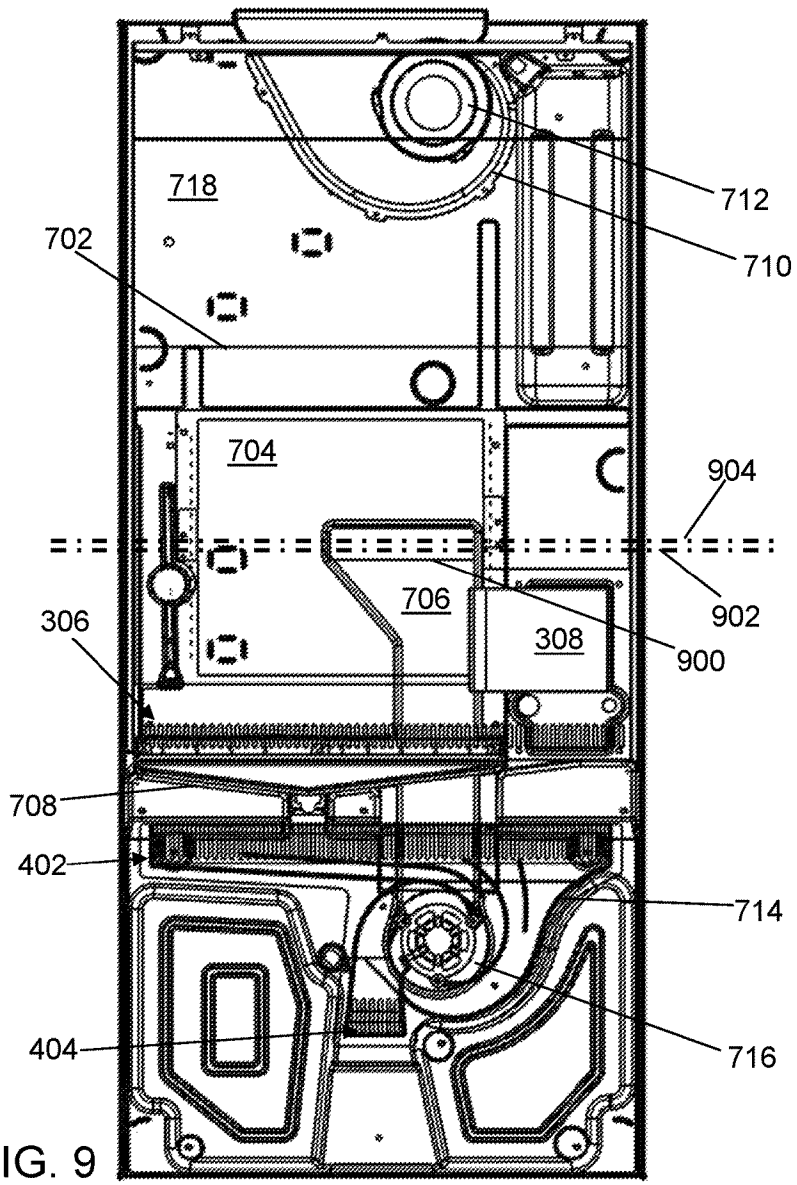
FIG. 9 depicts a front view of the air flow system of FIG. 8 in accordance with an illustrative embodiment where a plurality of plates and an evaporator are shown transparent.
Figure 11:
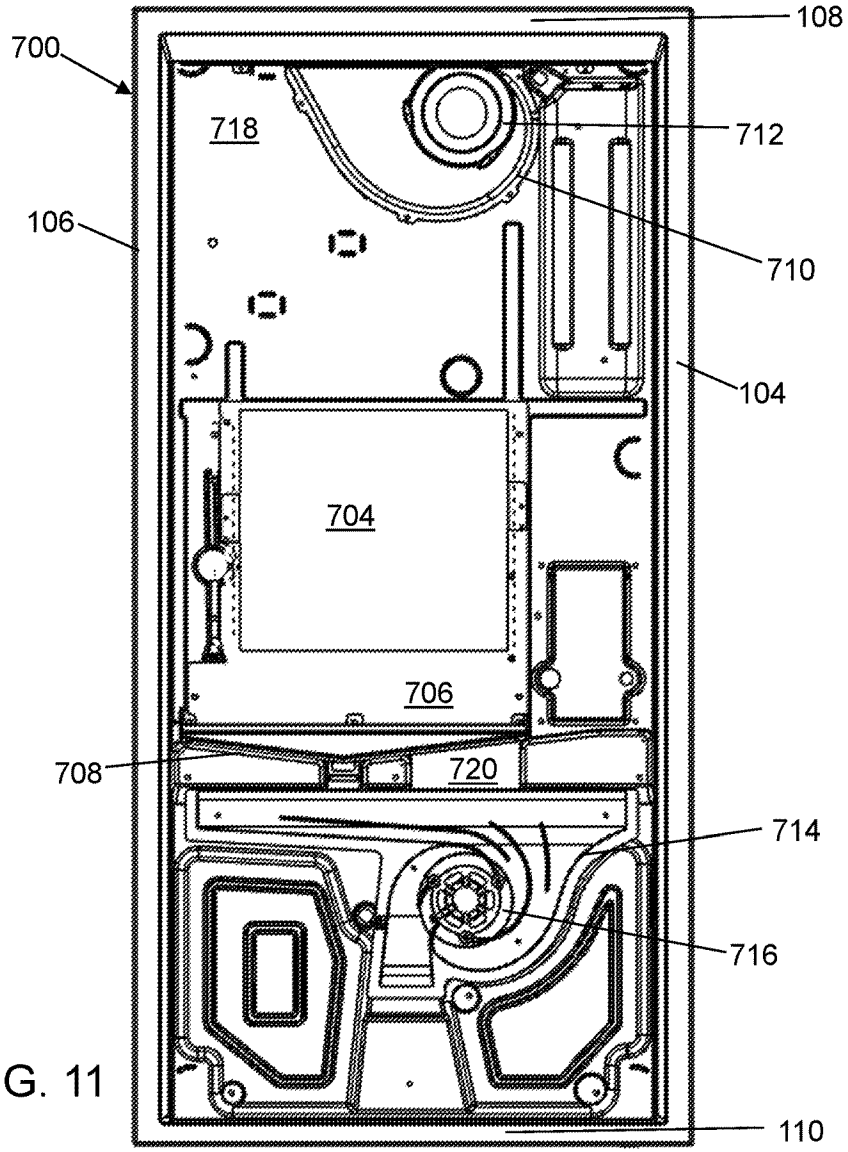
FIG. 11 depicts a front view of the refrigerator of FIG. 1 with the door, a plurality of first zone wall plates, a second zone wall plate, and the drawer stack removed in accordance with an illustrative embodiment.

Referring to FIG. 9, a front view of air flow system 800 without cabinet 700 is shown in accordance with an illustrative embodiment. Evaporator front cover 702, evaporator 704, and evaporator back cover 706 are transparent so that the relative position between the components are visible. Referring to FIG. 10, a front view of refrigerator 100 with air flow system 800 mounted within cabinet 700 is shown in accordance with an illustrative embodiment where evaporator 704 is shown transparent and top vent plate 304 and evaporator front cover 702 have been removed. Referring to FIG. 11, a front view of refrigerator 100 is shown with air flow system 800 mounted within cabinet 700 where top vent plate 304, bottom vent plate 400, and evaporator front cover plate 702 have been removed in accordance with an illustrative embodiment.

An aperture wall 900 is formed in evaporator back cover 706 and positioned relative to evaporator 704 to provide an aperture through which a portion of the cooled air from evaporator 704 can be drawn based on operation of second fan 3730. For example, when second fan 3730 is in an "Off" state under control of refrigerator controller 3700, little or no cooled air flows through aperture wall 900 toward second zone 312. A remainder or approximately all of the cooled air from evaporator 704 can be drawn upwards toward first fan 3728 when first fan 3728 is operated to an "On" state by refrigerator controller 3700 depending on whether or not second fan 3730 is operated to the "On" state by refrigerator controller 3700.

In the illustrative embodiment, aperture wall 900 defines a single rectangular aperture though this is not required. For example, aperture wall 900 may form other shapes including circular, elliptical, square, etc. A size and location formed by aperture wall 900 may be selected based on an amount of cooling needed for second zone 312 relative to first zone 310. For example, the size and location may be determined based on its effect on the cooling of first zone 310 and how cold evaporator 704 is when only second zone 312 is being cooled. For illustration, if the aperture stretched across a full length of evaporator 704, cooling of first zone 310 is reduced unacceptably.

An evaporator vertical center line 902 indicates a vertical center through evaporator 704. An aperture vertical center line 904 indicates a vertical center through aperture wall 900. In the illustrative embodiment, aperture vertical center line 904 is slightly above evaporator center line 902. As a result, air drawn through aperture wall 900 is from approximately a vertical center of evaporator 704 though this is not required. Aperture vertical center line 904, for example, may be positioned at any vertical location above a lower edge of evaporator 704 by at least 10% of a height of evaporator 704 or below an upper edge of evaporator 704 by at least 10% of the height of evaporator 704 such that only a portion of the cooled air is withdrawn from evaporator 704 when second fan 3730 is operated. In the illustrative embodiment, aperture wall 900 positioned near aperture vertical center line 904 and extending approximately half of an evaporator width of evaporator 704 provided a best cooling operation for both first zone 310 and second zone 312 when both zones were being cooled and kept evaporator 704 from getting too cold when only second zone 312 was being cooled.

An evaporator horizontal center line 1000 indicates a horizontal center through evaporator 704. An aperture horizontal center line 1002 indicates a horizontal center through aperture wall 900. In the illustrative embodiment, aperture horizontal center line 1002 is well to the right of evaporator horizontal center line 1000 making aperture wall 900 formed across an approximately right half of evaporator 704. Aperture horizontal center line 1002, for example, may be positioned at any horizontal location to the right of a left edge of evaporator 704 or to the left of a right edge of evaporator 704 based on a width of aperture wall 900. At the selected aperture vertical center line 904 and aperture horizontal center line 1002 location, aperture wall 900 extends partially across a width of evaporator 704 as shown in FIG. 9.

Figure 12:
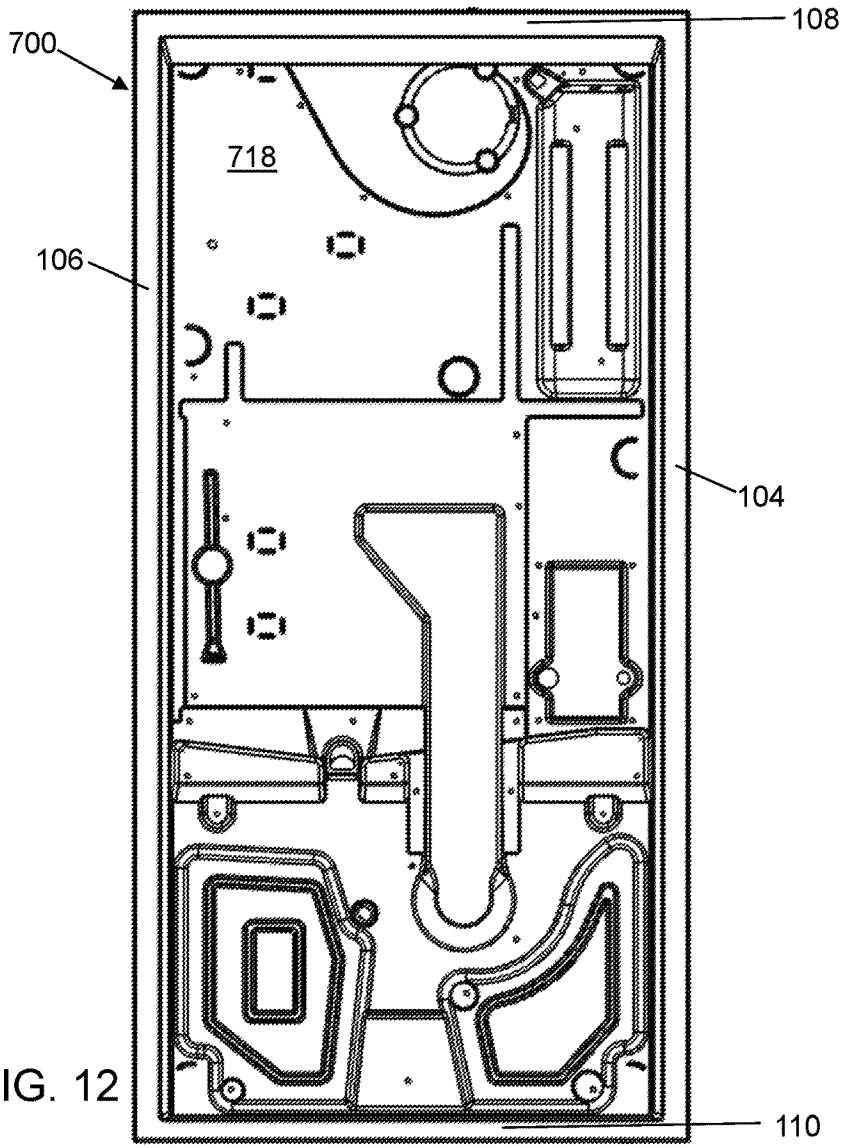
FIG. 12 depicts a front view of a back liner mounted in a cabinet of the refrigerator of FIG. 1 in accordance with an illustrative embodiment.
Figure 14:
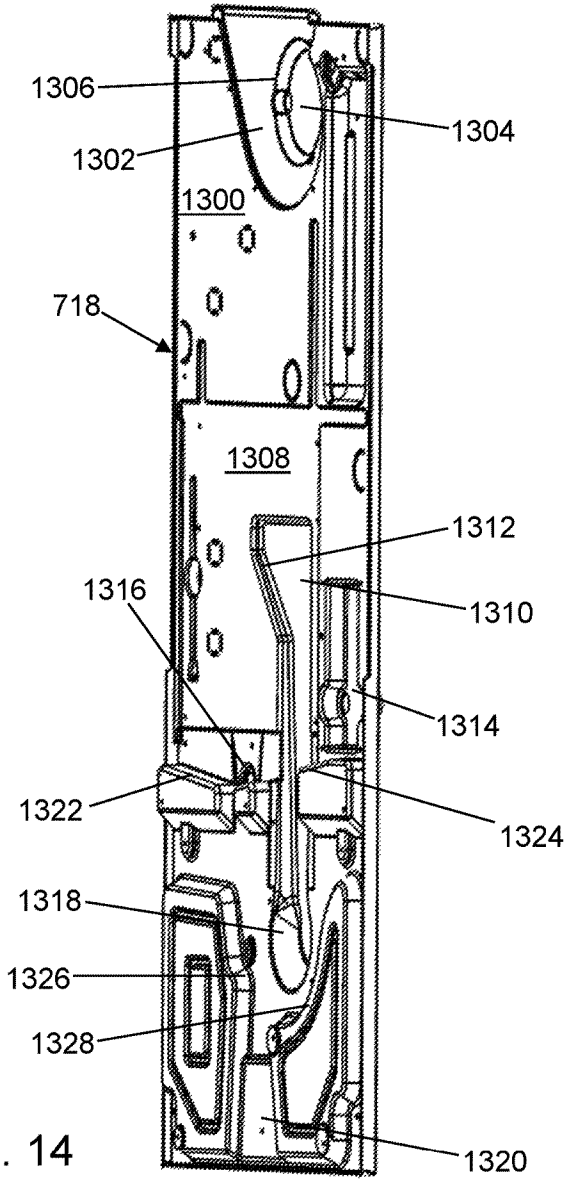
FIG. 14 depicts a right, front, perspective view of the back liner of FIG. 12 in accordance with an illustrative embodiment.
Figure 13:
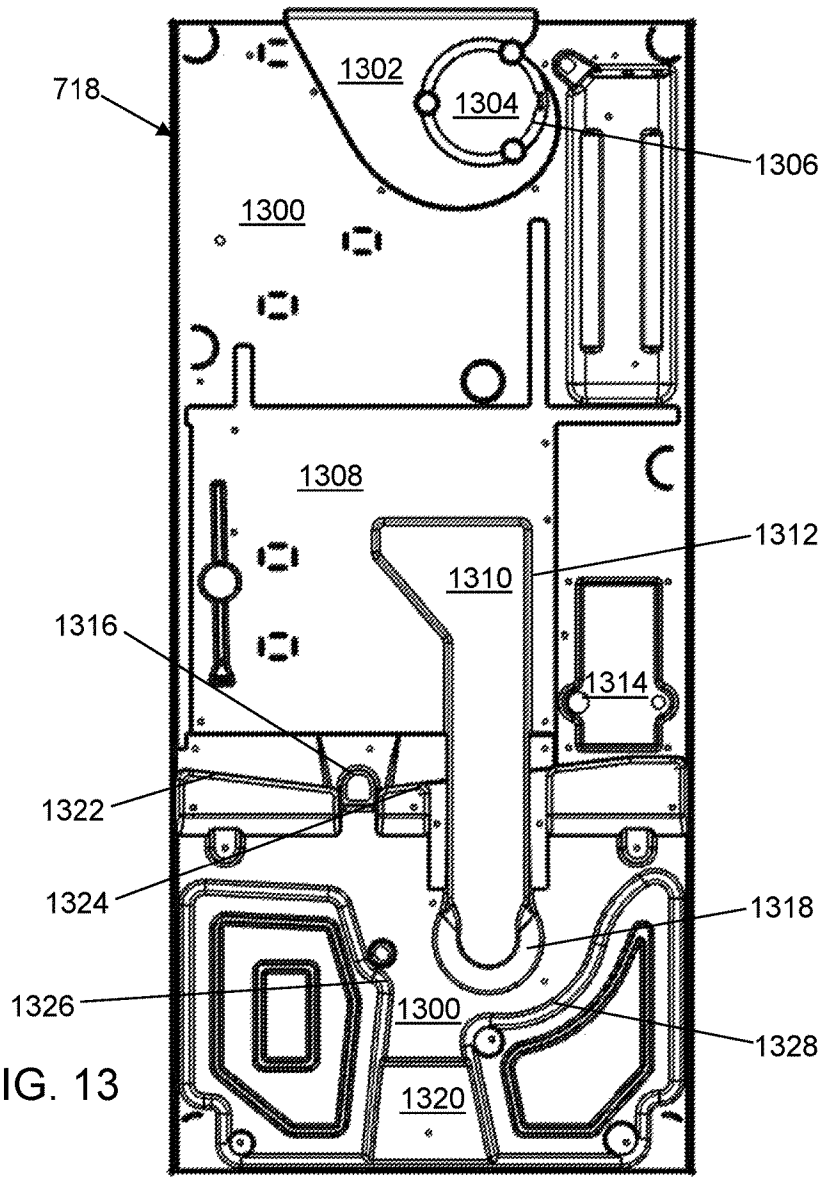
FIG. 13 depicts a front view of the back liner of FIG. 12 in accordance with an illustrative embodiment.

Referring to FIG. 12, a front view of back liner 718 mounted in cabinet 700 is shown in accordance with an illustrative embodiment. Referring to FIG. 13, a front view of back liner 718 is shown in accordance with an illustrative embodiment. Referring to FIG. 14, a right, front, perspective view of back liner 718 is shown in accordance with an illustrative embodiment. Back liner 718 may include a plate 1300 that is generally flat but includes various depressions and protrusions formed therein or thereon to provide a mounting location for components of air flow system 800 and to provide duct walls to supply air to first fan 3728 and/or second fan 3730. For example, back liner 718 may include a first fan shroud depression 1302, a first fan housing depression 1304, a first fan housing wall 1306, an evaporator depression 1308, a second zone duct depression 1310, a second zone duct wall 1312, an air filter depression 1314, drain aperture wall 1316, a second fan housing wall 1318, a bottom duct wall 1320, a first drain shelf wall 1322, a second drain shelf wall 1324, a first shroud shelf wall 1326, and a second shroud shelf wall 1328.

First shroud 710 fits within the walls that define first fan shroud depression 1302 that act as a guide and a support for mounting first shroud 710 to back liner 718. First fan housing 712 fits within first fan housing wall 1306 that defines first fan housing depression 1304. First fan housing wall 1306 is a guide and a support for mounting first fan housing 712 to back liner 718. Second fan housing 716 fits within second fan housing wall 1318 that acts as a guide and a support for mounting second fan housing 716 to back liner 718. In the illustrative embodiment, first fan housing 712 and second fan housing 716 are not directly mounted to liner back 718. Instead, first fan housing 712 and second fan housing 716 are mounted to first fan shroud 710 and to second fan shroud 714, respectively, that are mounted to liner back 718. First shroud shelf wall 1326 and second shroud shelf wall 1328 are walls of protrusions from plate 1300 that act as a guide and a support for mounting second shroud 714 to back liner 718. The air filter fits within the walls that define air filter depression 1314. Various fasteners and fastening methods may be used to mount first shroud 710, first fan housing 712, second shroud 714, and second fan housing 716 to back liner 718.

First drain shelf wall 1322 and second drain shelf wall 1324 are protrusions from plate 1300 that act as a guide and a support for mounting drain trough 708 to back liner 718. Various fasteners and fastening methods may be used to mount drain trough 708 to back liner 718. Bottom duct wall 1320 is a protrusion from plate 1300 that has a lower height relative to plate 1300 than first drain shelf wall 1322 and second drain shelf wall 1324 to define an air duct for air flow from second fan 3730 toward bottom wall 110.

Evaporator 704 fits within the walls that define evaporator depression 1308. Evaporator depression 1308 is a guide and a support for mounting evaporator 704 to back liner 718 and facilitates air flow around evaporator 704.

Second zone duct depression 1310 defined by second zone duct wall 1312 formed in plate 1300 and in evaporator depression 1308 defines an air duct for air flow from evaporator 704 through aperture wall 900 to second fan 3730. A top portion of second zone duct wall 1312 is aligned with aperture wall 900 to define an intake point for the air from evaporator 704. The top portion of second zone duct wall 1312 may also funnel air from a left-side of aperture wall 900 to a channel portion that is approximately a width of second fan housing wall 1318.

Back liner 718 may have variously shaped protrusions and depressions based on an arrangement and shape of the components of air flow system 800 that mount to back liner 718. The described components can be arranged in other orientations based on their relative location. For example, the described vertical direction may be a horizontal direction in an alternative embodiment, and/or may be positioned on or near a left-side or a center of evaporator 704.

Figure 15:
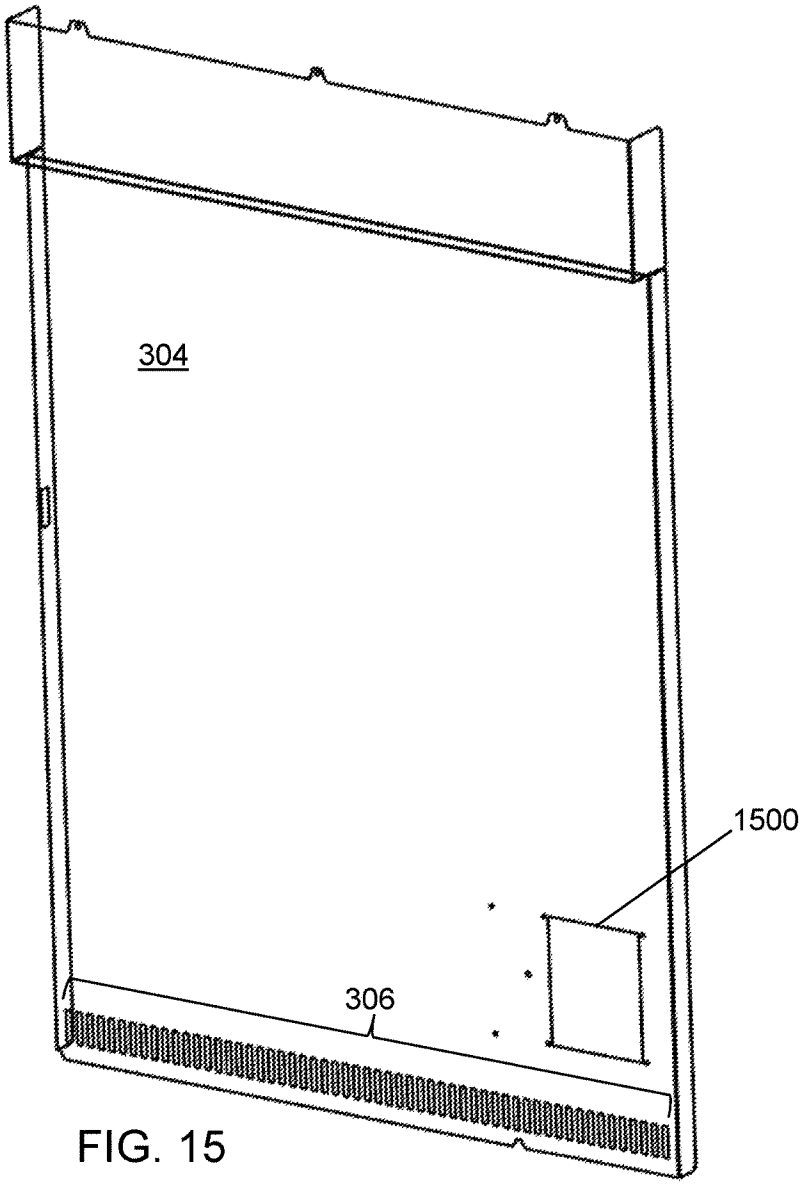
FIG. 15 depicts a right, front, perspective view of a top vent plate of the air flow system of FIG. 8 in accordance with an illustrative embodiment.

Referring to FIG. 15, a right, front, perspective view of top vent plate 304 is shown in accordance with an illustrative embodiment. Top vent plate 304 may further include an air purifier aperture wall 1500 formed therethrough. Air purifier cover plate 308 may cover the opening defined by air purifier aperture wall 1500 that provides access to the air filter that may be mounted in air filter depression 1314.

Figure 16:
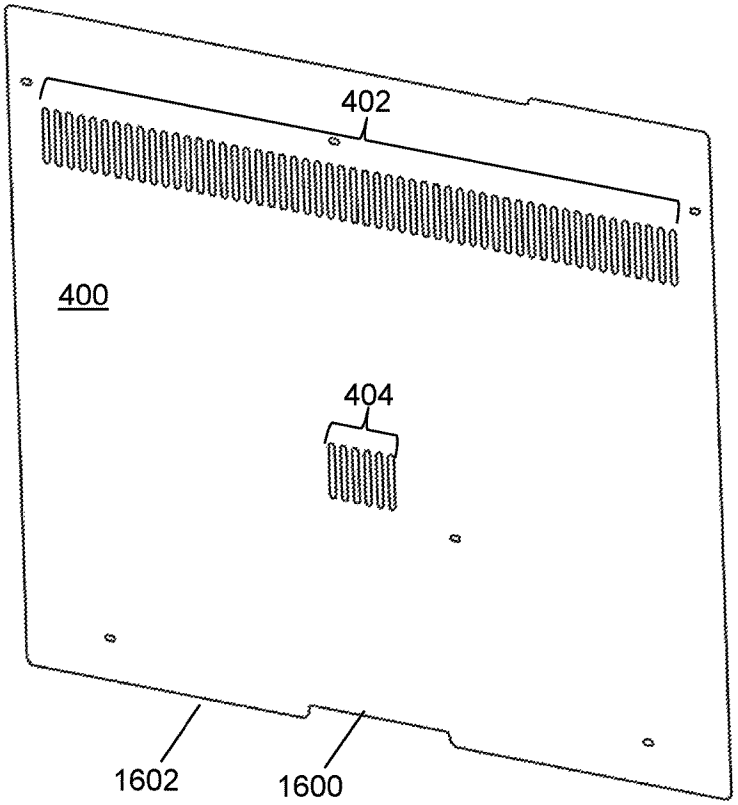
FIG. 16 depicts a right, front, perspective view of a bottom vent plate of the air flow system of FIG. 8 in accordance with an illustrative embodiment.

Referring to FIG. 16, a right, front, perspective view of bottom vent plate 400 is shown in accordance with an illustrative embodiment. A lower duct indentation 1600 in bottom edge 1602 of bottom vent plate 400 may provide an opening through which cooled air can flow from bottom duct wall 1320 to bottom wall 110 below drawer stack 300. Second zone top plurality of vents 402 and second zone middle plurality of vents 404 are positioned, sized, and shaped to provide cooled air behind drawer stack 300 of second zone 312. In the illustrative embodiment, second zone top plurality of vents 402 are designed to provide cooling to first drawer 500 that is a deli drawer 500 and to second drawer 502 that is an upper crisper drawer while second zone middle plurality of vents 404 are designed to provide cooling to third drawer 504 and to fourth drawer 506 that are middle and lower crisper drawers, respectively. Since cold air settles, second zone top plurality of vents 402 includes more vents than second zone middle plurality of vents 404. A goal in the illustrative embodiment was to achieve one degree of temperature stratification for all four drawers of drawer stack 300. The location of second zone top plurality of vents 402 and second zone middle plurality of vents 404 is further selected in combination with a shape of back liner 718 relative to second fan 3730. In other embodiments, other positions, sizes/numbers, and shapes of vents may be used based on a desired cooling of drawer stack 300 as well as a drawer stack arrangement used.

Figure 17:
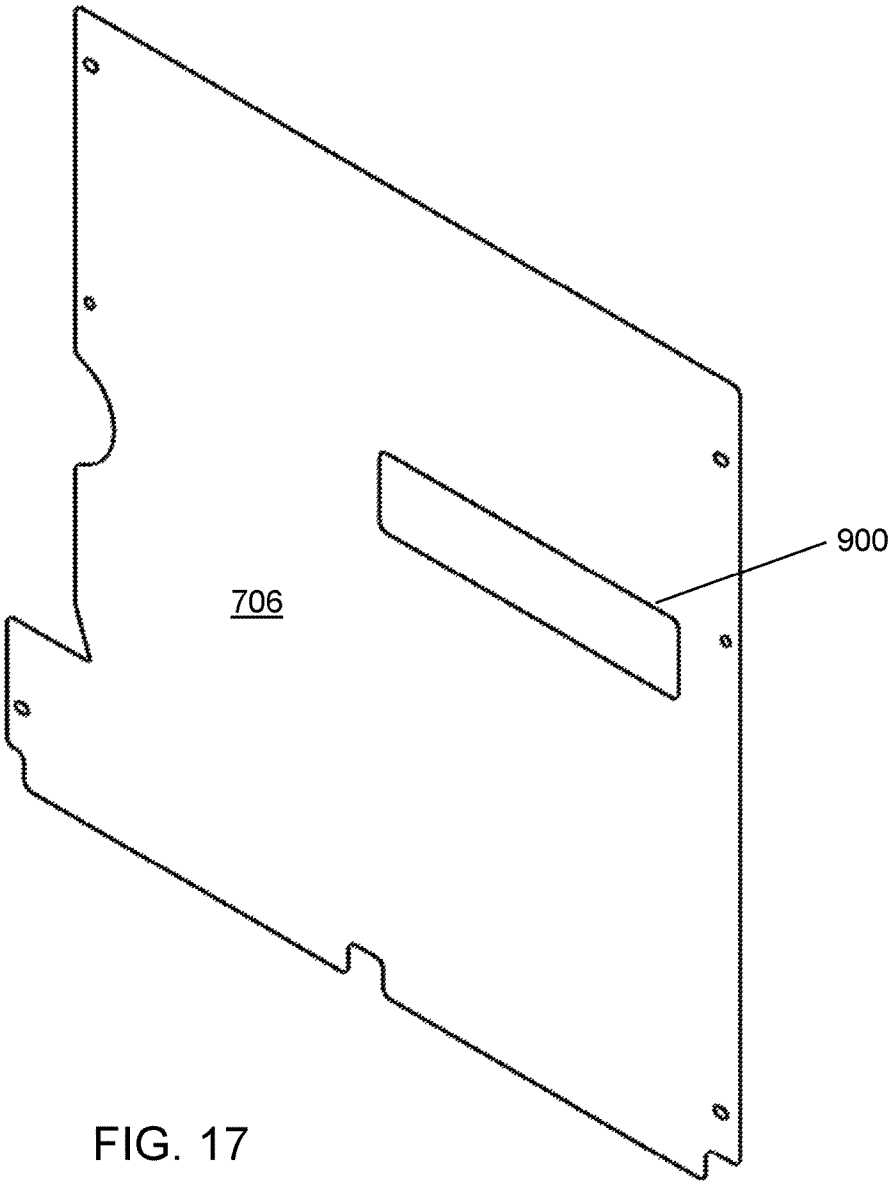
FIG. 17 depicts a right, front, perspective view of an evaporator back cover of the air flow system of FIG. 8 in accordance with an illustrative embodiment.

Referring to FIG. 17, a right, front, perspective view of evaporator back cover 706 is shown with aperture wall 900 formed therethrough in accordance with an illustrative embodiment. Evaporator back cover 706 blocks a flow of air from evaporator 704 to second zone duct depression 1310 except through aperture wall 900 so that a remainder of air flows upward toward first fan 3728 when first fan 3728 is on. Evaporator back cover 706 and lower duct cover plate 720 are mounted over second zone duct depression 1310 to form an enclosure that keeps air from escaping second zone duct depression 1310 before it reaches second fan 3730. When neither first fan 3728 or second fan 3730 are on, the air within first zone 310 and second zone 312 is generally stagnate and moves based on opening or closing of door 102 and on the laws of thermodynamics such that warmer air tends to move upwards. Aperture wall 900 is adjacent a right-side of evaporator 704 because second fan 3730 is positioned on a right-side of evaporator 704. As discussed previously, Aperture wall 900 may have various sizes, shapes, and locations depending on the embodiment.

Figure 18:
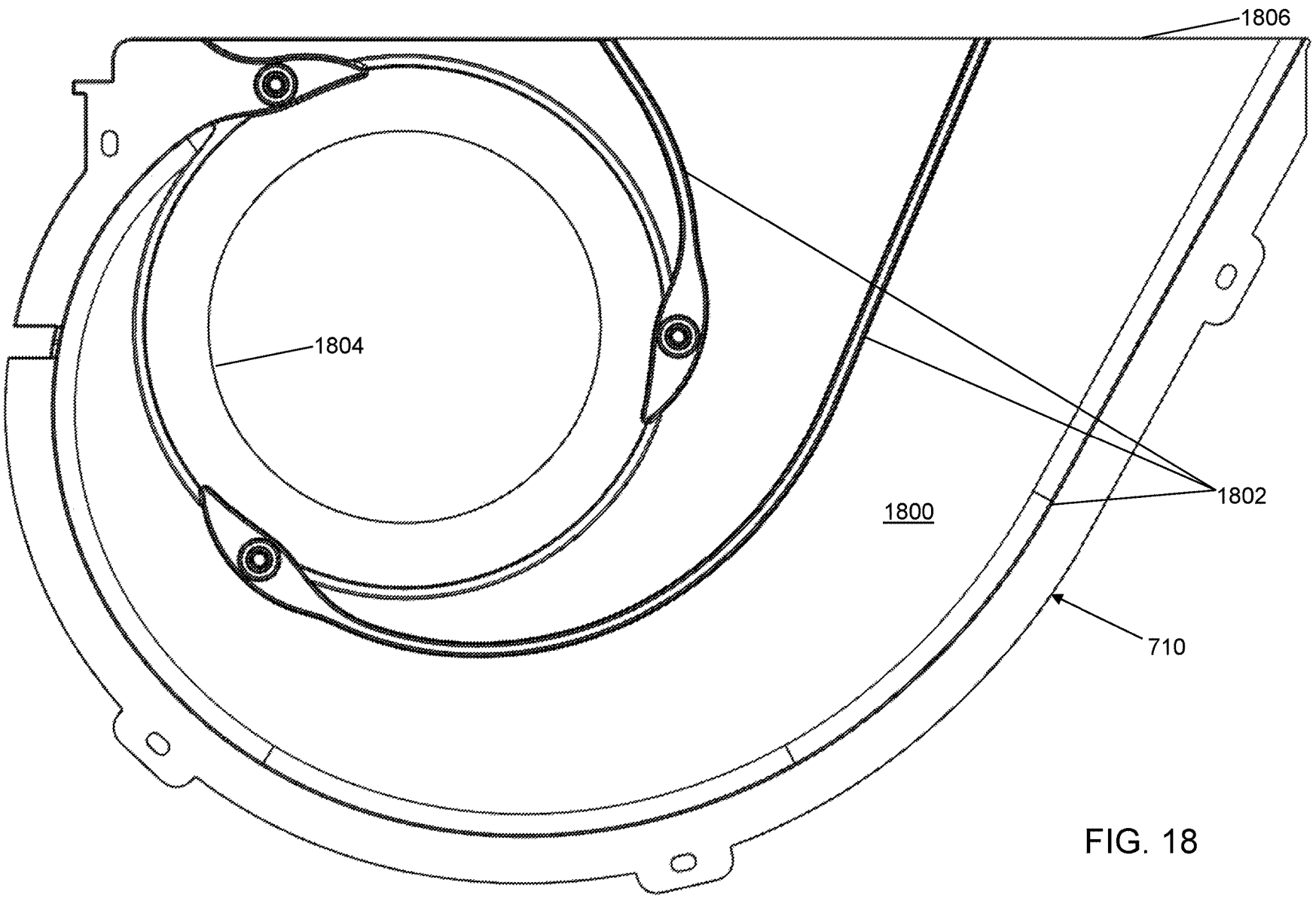
FIG. 18 depicts a front view of a first shroud of the air flow system of FIG. 8 in accordance with an illustrative embodiment.
Figure 19:
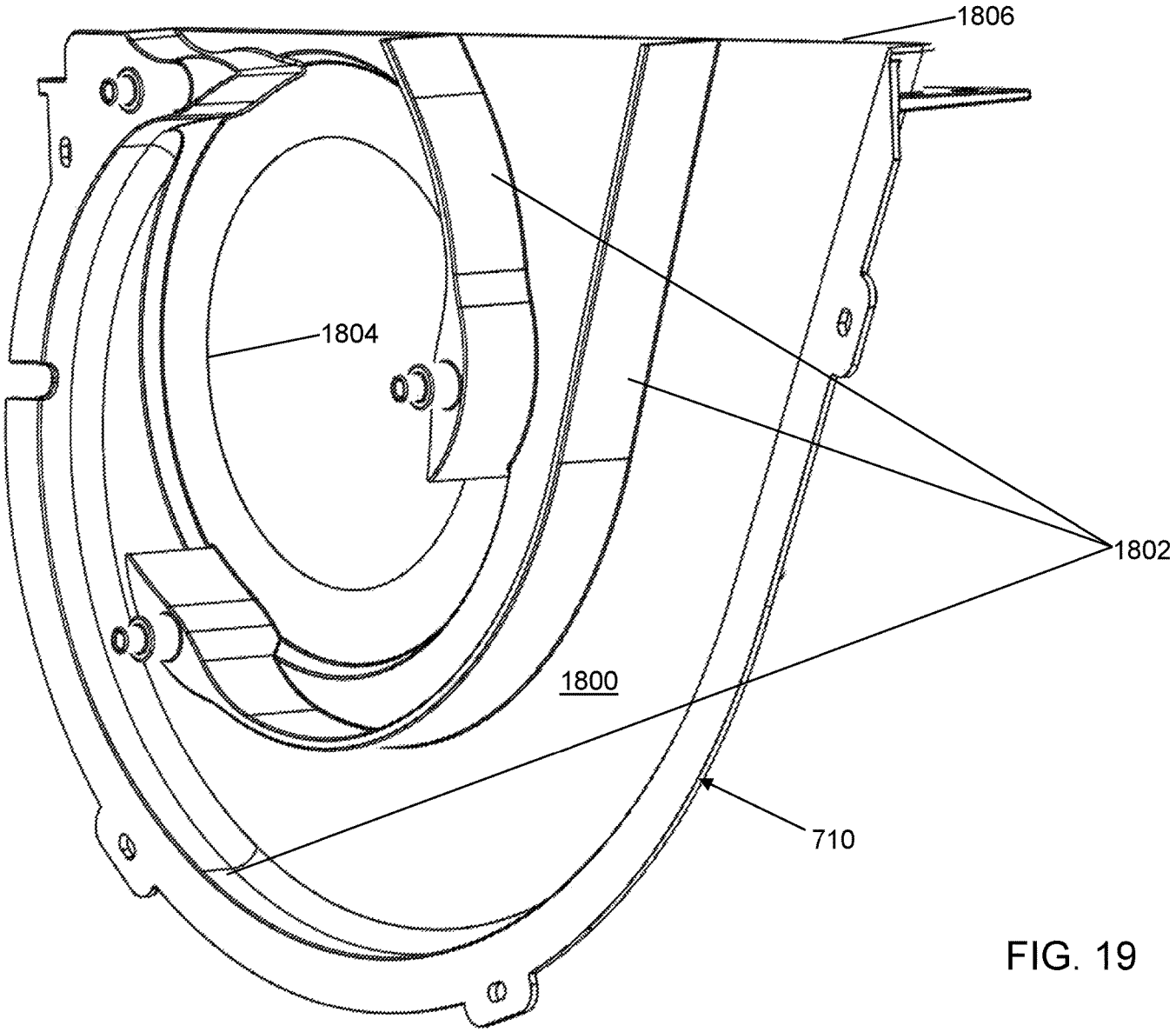
FIG. 19 depicts a right, front, perspective view of the first shroud of FIG. 18 in accordance with an illustrative embodiment.

Referring to FIG. 18, a front view of first shroud 710 is shown in accordance with an illustrative embodiment. FIG. 19, a right, front, perspective view of first shroud 710 is shown in accordance with an illustrative embodiment. In the illustrative embodiment, first shroud 710 includes a first shroud base plate 1800, a plurality of first shroud vanes 1802, a first shroud fan aperture wall 1804, and an air distribution edge 1806. First fan 3728 is centered in first shroud fan aperture wall 1804. The plurality of first shroud vanes 1802 extend outward from first shroud base plate 1800 that is generally flat. The plurality of first shroud vanes 1802 are shaped to direct air from first fan 3728 such that the air exits along air distribution edge 1806. In the illustrative embodiment, the plurality of first shroud vanes 1802 include three spirally curved walls that are equally dispersed circumferentially around first shroud fan aperture wall 1804, which is circular in shape, to provide relatively equal distribution of the air that exits along air distribution edge 1806. Other shrouds and/or shroud mounting locations may be used in alternative embodiments based on the desired air dispersion into first zone 310 and the associated vent location(s).

Figure 20:
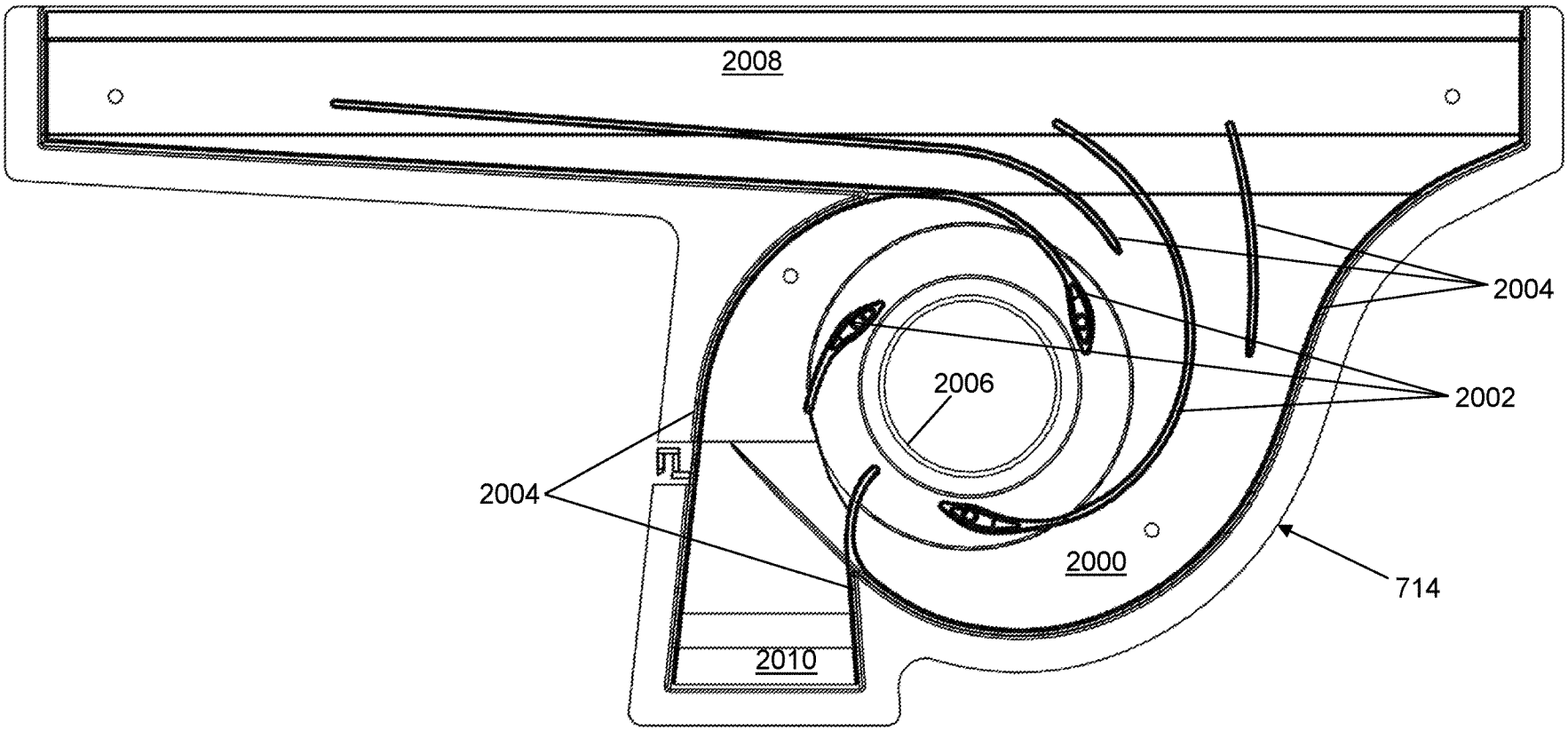
FIG. 20 depicts a front view of a second shroud of the air flow system of FIG. 8 in accordance with an illustrative embodiment.
Figure 21:
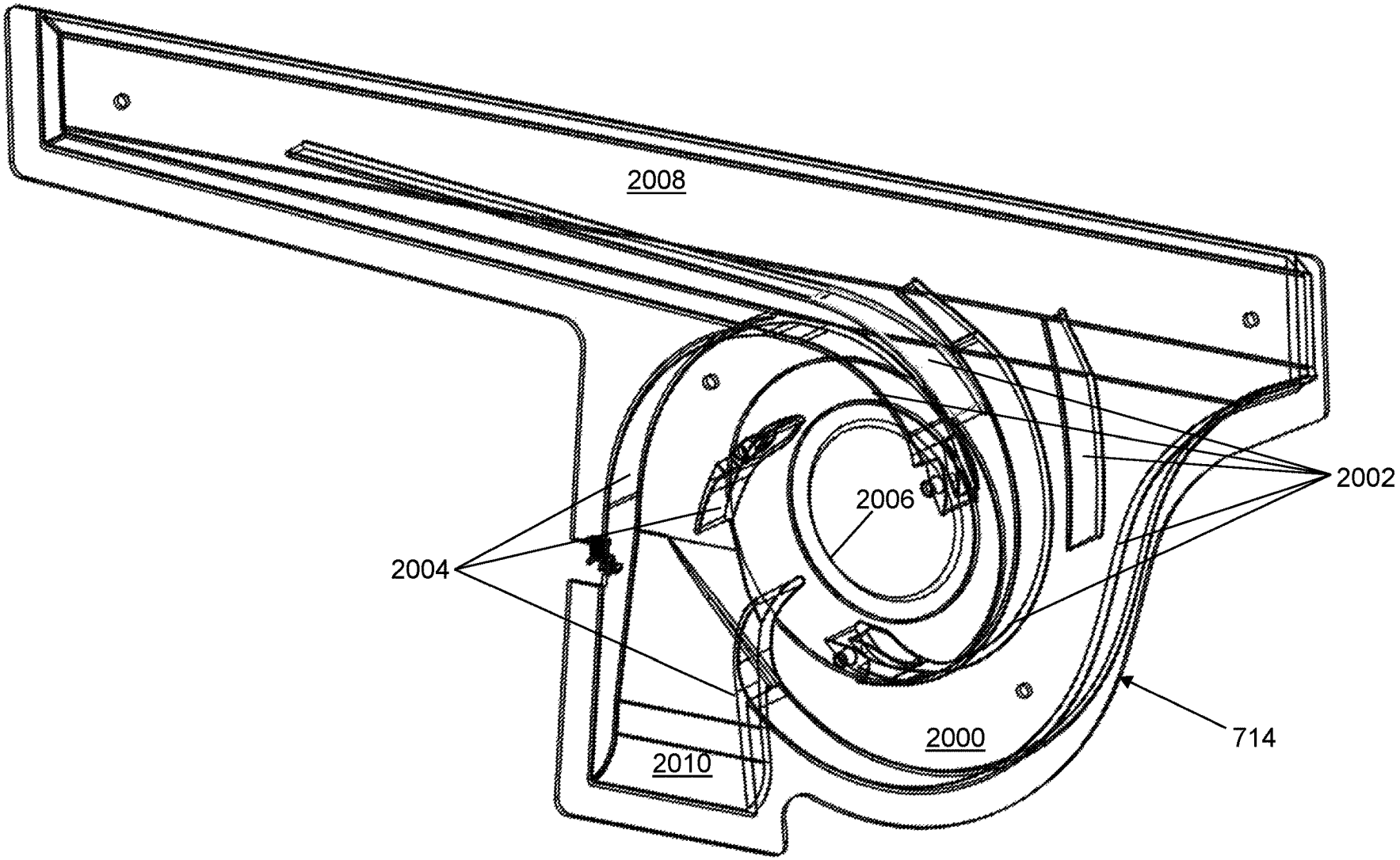
FIG. 21 depicts a right, front, perspective view of the second shroud of FIG. 21 in accordance with an illustrative embodiment.

Referring to FIG. 20, a front view of second shroud 714 is shown in accordance with an illustrative embodiment. Referring to FIG. 21, a right, front, perspective view of second shroud 714 is shown in accordance with an illustrative embodiment. In the illustrative embodiment, second shroud 714 includes a second shroud base plate 2000, a first plurality of second shroud vanes 2002, a second plurality of second shroud vanes 2004, a second shroud fan aperture wall 2006, a first air distribution plate 2008, and a second air distribution plate 2010. Second fan 3730 is centered in second shroud fan aperture wall 2006.

The first plurality of second shroud vanes 2002 and the second plurality of second shroud vanes 2004 extend outward from second shroud base plate 2000 that is generally flat. The first plurality of second shroud vanes 2002 and the second plurality of second shroud vanes 2004 are shaped to direct air from second fan 3730 such that a first portion of the air exits along first air distribution plate 2008 through second zone top plurality of vents 402 and a second portion of the air exits along second air distribution plate 2010 through second zone middle plurality of vents 404. Any remaining air that does not exit through second zone middle plurality of vents 404 flows further downward along bottom duct wall 1320 to exit through lower duct indentation 1600 in bottom edge 1602 of bottom vent plate 400.

In the illustrative embodiment, the first plurality of second shroud vanes 2002 include three curved walls that are equally dispersed circumferentially around second shroud fan aperture wall 2006, which is circular in shape, to provide relatively equal distribution of the air that exits second fan 3730. The air is split such that approximately half of the air exits along first air distribution plate 2008 and the remainder of the air exits along second air distribution plate 2010. The second plurality of second shroud vanes 2004 include two interior routing walls and three exterior routing walls. Other shrouds and/or shroud mounting locations may be used in alternative embodiments based on the desired air dispersion into second zone 312 and the associated vent location(s).

Operation of second fan 3730 pulls air through aperture wall 900 down to be dispersed by second shroud 714 around drawer stack 300. The dispersed air is pulled through the plurality of intake vents 306 toward evaporator 704 that cools the air again. Operation of first fan 3728 pulls cooled air up from evaporator 704 outward and down into first zone 310. The dispersed air is also pulled through the plurality of intake vents 306 toward evaporator 704 that cools the air again.

Figure 22:
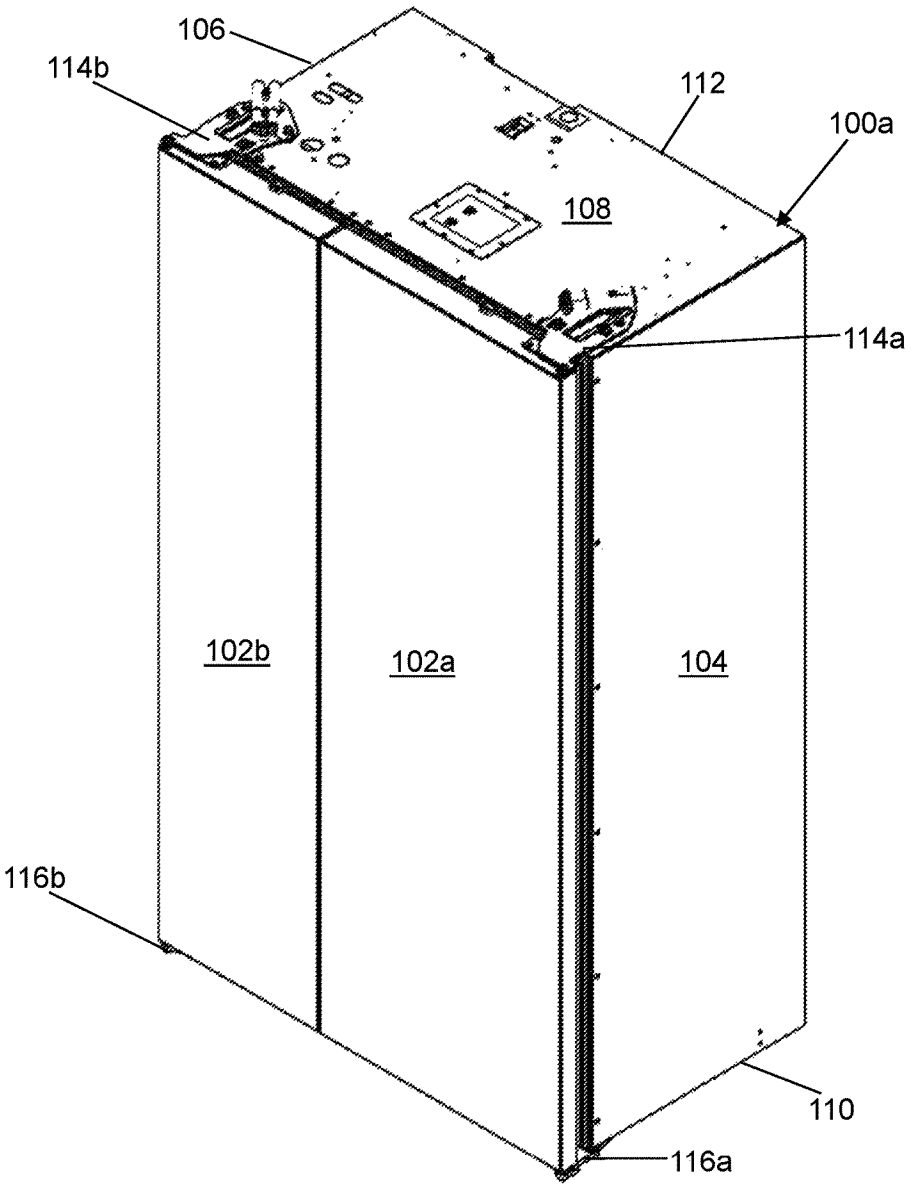
FIG. 22 depicts a right, front, perspective view of a second refrigerator in accordance with an illustrative embodiment.

Referring to FIG. 22, a right, front, perspective view of a second refrigerator 100*a* is shown in accordance with an illustrative embodiment. Second refrigerator 100*a* may include one or more compartments or cooling zones. Second refrigerator 100*a* may include a right door 102*a*, a left door 102*b*, right wall 104, left wall 106, top wall 108, bottom wall 110, and back wall 112 that define an interior cavity within which items can be placed for cooling. A first top hinge 114*a* and a first bottom hinge 116*a* mount right door 102*a* to top wall 108 and to bottom wall 110, respectively. A second top hinge 114*b* and a second bottom hinge 116*b* mount left door 102*b* to top wall 108 and to bottom wall 110, respectively.

An additional wall plate may be used to cover an exterior of any of right door 102*a*, left door 102*b*, right wall 104, left wall 106, top wall 108, bottom wall 110, and back wall 112 in an alternative embodiment to improve an aesthetic appearance of second refrigerator 100*a*. In the illustrative embodiment of FIG. 22, second refrigerator 100*a* includes a first compartment behind right door 102*a* and a second compartment behind left door 102*b*. The first compartment may be similar to the single compartment of refrigerator 100 and defined by cabinet 700 minus left wall 106, a dividing wall (not shown) that forms a left wall of the first compartment, and right door 102*a*. The second compartment may be defined by cabinet 700 minus right wall 104, the dividing wall that forms a right wall of the first compartment, and left door 102*b*. In the illustrative embodiment, the dividing wall extends between top wall 108 and bottom wall 110 though the dividing wall may be positioned between right wall 104 and left wall 106 in an alternative embodiment.

Each compartment may provide a freezer zone or a refrigerated zone. For example, in the illustrative embodiment, the second compartment may be a freezer zone that is designed to operate below 32° Fahrenheit (° F.), for example, based on a selection using a third temperature control 3726 (shown referring to FIG. 37). In general, a temperature of the freezer zone is maintained at an adequate temperature to maintain food stored therein in a frozen state. A third temperature sensor 3724 (shown referring to FIG. 37) may measure a current temperature within the second compartment. For illustration, third temperature sensor 3724 may be a thermistor electrically connected either by wire or wirelessly to refrigerator controller 1300 to provide the measured temperature periodically, continuously, when requested, etc.

In alternative embodiments, second refrigerator 100*a* may include a fewer or a greater number of compartments arranged vertically and/or horizontally with respect to each other. The dividing wall that separates the first compartment from the second compartment may or may not be insulated. Though not shown, the first compartment may include drawer stack 300 and shelf 102 similarly mounted in a lower section of the first compartment.

Figure 23:
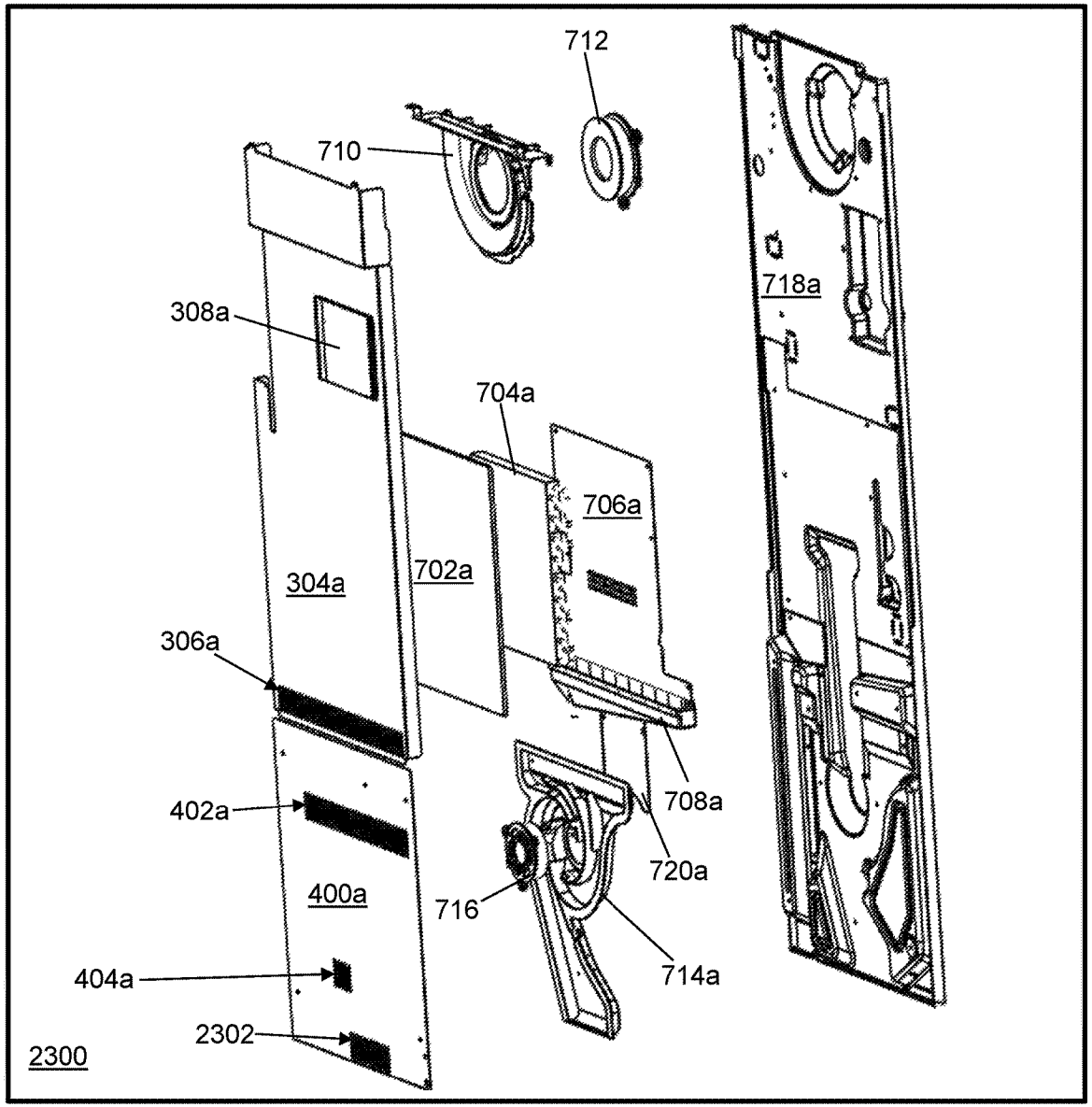
FIG. 23 depicts a right, front, perspective, exploded view of an air flow system of the second refrigerator of FIG. 22 in accordance with an illustrative embodiment.

Referring to FIG. 23, a right, front, perspective, exploded view of a second air flow system 2300 of second refrigerator 100*a* is shown in accordance with an illustrative embodiment. Second air flow system 2300 may include a second top vent plate 304*a*, a second bottom vent plate 400*a*, a second evaporator front cover plate 702*a*, a second evaporator 704*a*, a second evaporator back cover plate 706*a*, a second drain trough 708*a*, first fan shroud 710, first fan housing 712, a third fan shroud 714*a*, second fan housing 716, and a second back liner 718*a*. Second top vent plate 304*a* may include a second plurality of intake vents 306*a* similar to the plurality of intake vents 306 and a second air purifier cover plate 308*a* similar to air purifier cover plate 308 though in a different location. Second bottom vent plate 400*a* may include a fourth zone top plurality of vents 402*a*, a fourth zone middle plurality of vents 404*a*, and a fourth zone bottom plurality of vents 2302 formed therethrough similar to second zone top plurality of vents 402 and second zone middle plurality of vents 404 though in different locations.

Second top vent plate 304*a*, second bottom vent plate 400*a*, and second back liner 718*a* form portions of back wall 112 though second air flow system 800*a* may be included in other walls of the first compartment in alternative embodiments. The components of second air flow system 800*a* may be formed of one or more materials, such as metal, glass, and/or plastic having a sufficient strength and rigidity to provide the illustrated and/or described function.

In the illustrative embodiment, second evaporator front cover plate 702*a* is mounted between second top vent plate 304*a* and second evaporator 704*a*, and second evaporator back cover plate 706*a* is mounted between second back liner 718*a* and second evaporator 704*a*. Second drain trough 708*a* is mounted below second evaporator 704*a* to catch condensation from second evaporator 704*a* and direct it out of back wall 112 using a drain port (not shown) mounted within a drain aperture wall (not shown) formed through second back liner 718*a*. Second back liner 718*a* may be formed of a plastic material through a vacuum molding process. Second top vent plate 304*a*, second bottom vent plate 400*a*, and second evaporator back cover plate 706*a* may be formed of sheet metal. Third fan shroud 714*a* may be formed of a plastic material. Like evaporator front cover plate 702, second evaporator front cover plate 702*a* is a panel that includes or is formed of an insulating material such as being formed of a foam material.

Second evaporator 704*a* may be similar to evaporator 704. A third evaporator (not shown) may be connected to a second compressor 3738 (shown referring to FIG. 37) to effect cooling of the second compartment independent of the first compartment though refrigerator controller 3700 may control cooling of both the first compartment and the second compartment.

Figure 25:
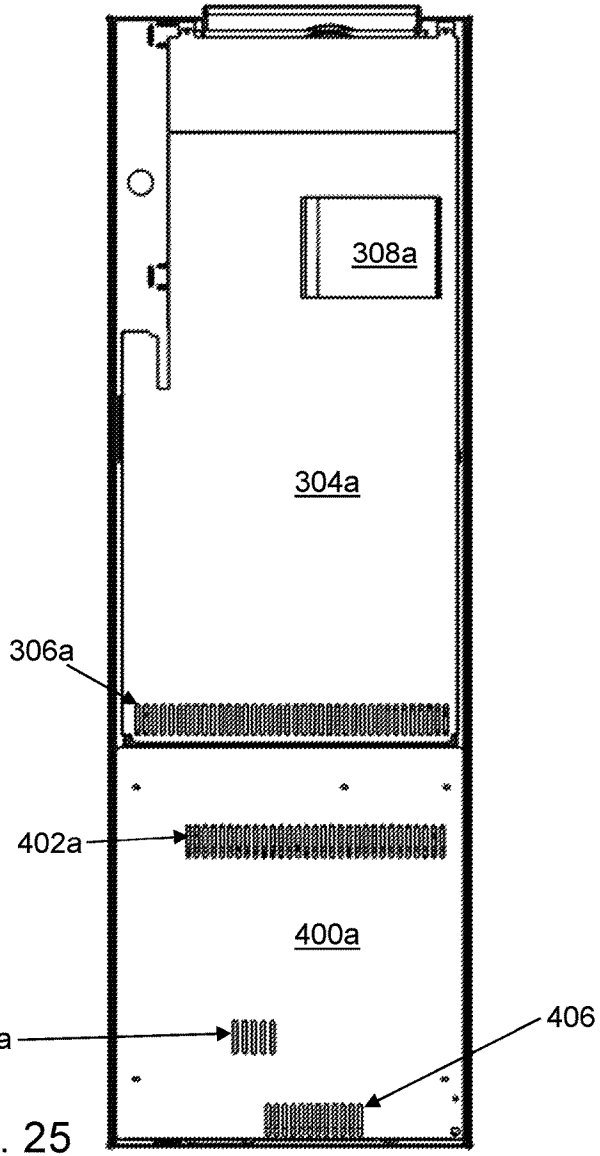
FIG. 25 depicts a front view of the air flow system of FIG. 23 in accordance with an illustrative embodiment.
Figure 24:
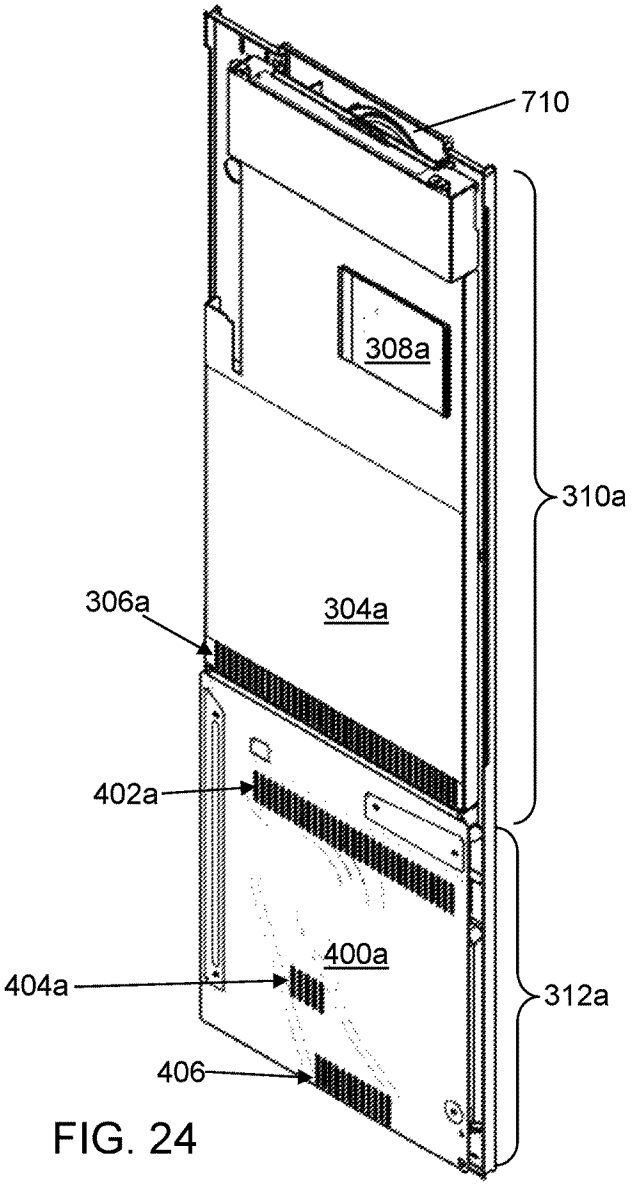
FIG. 24 depicts a right, front, perspective view of the air flow system of FIG. 23 in accordance with an illustrative embodiment.
Figure 27:
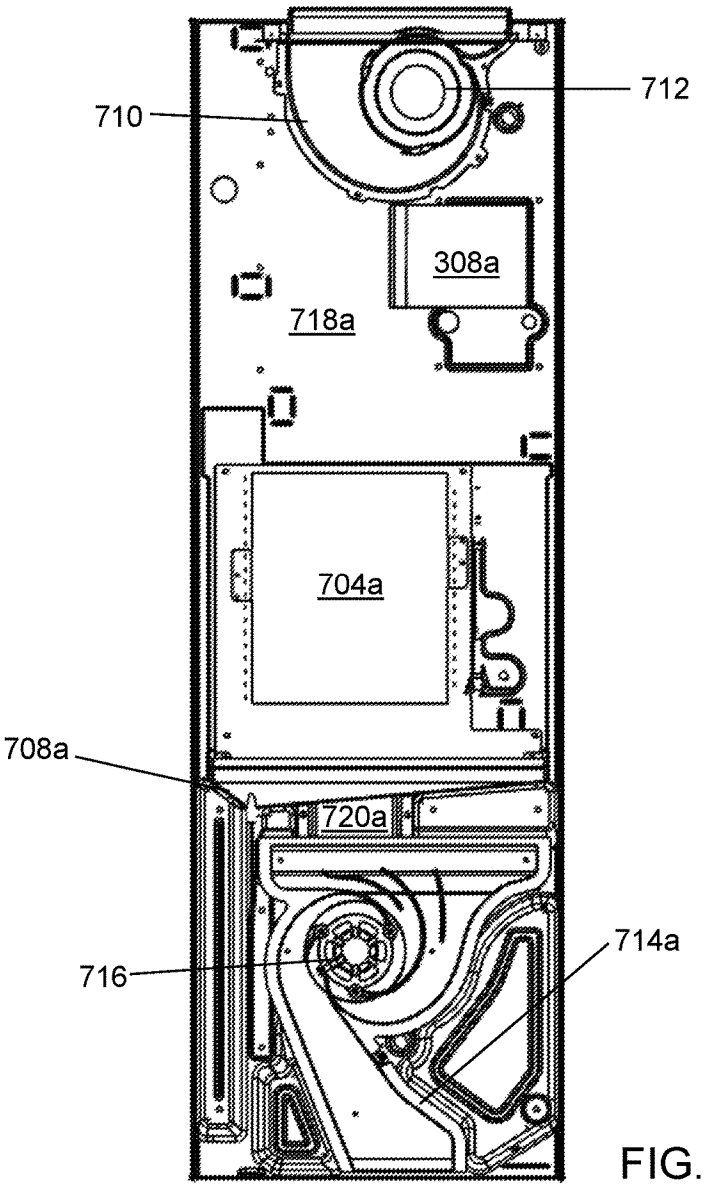
FIG. 27 depicts a front view of the air flow system of FIG. 26 with an evaporator front cover removed in accordance with an illustrative embodiment.
Figure 26:
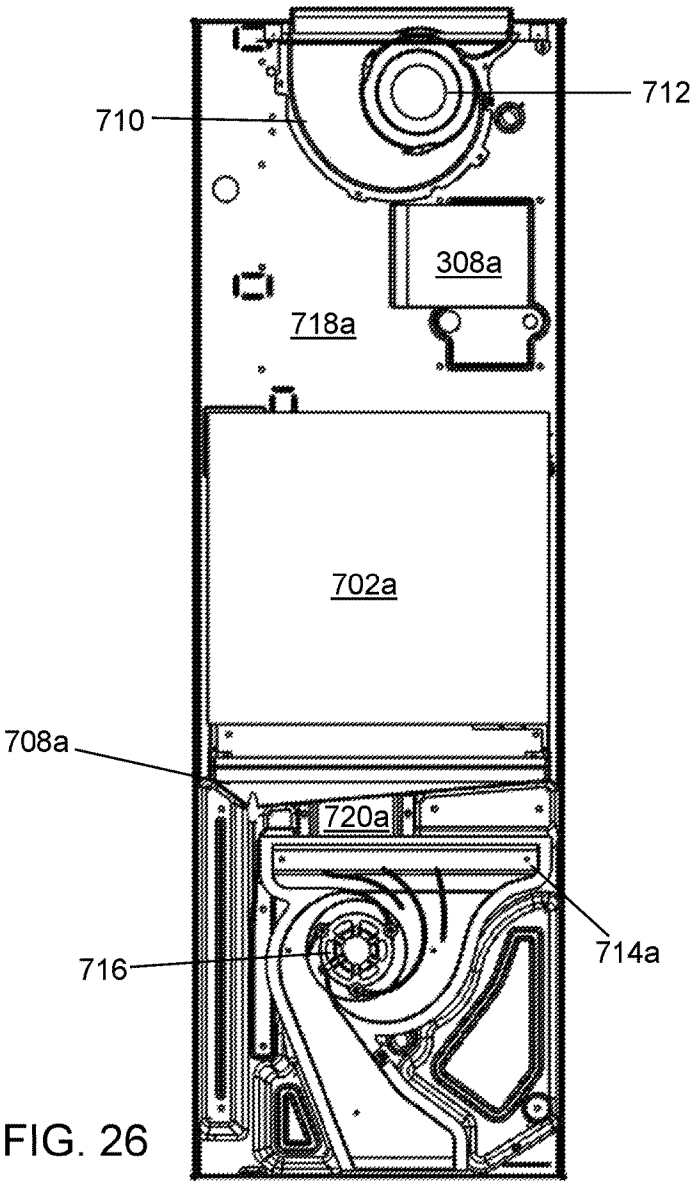
FIG. 26 depicts a front view of the air flow system of FIG. 23 with a top vent plate and a bottom vent plate removed in accordance with an illustrative embodiment.
Figure 29:
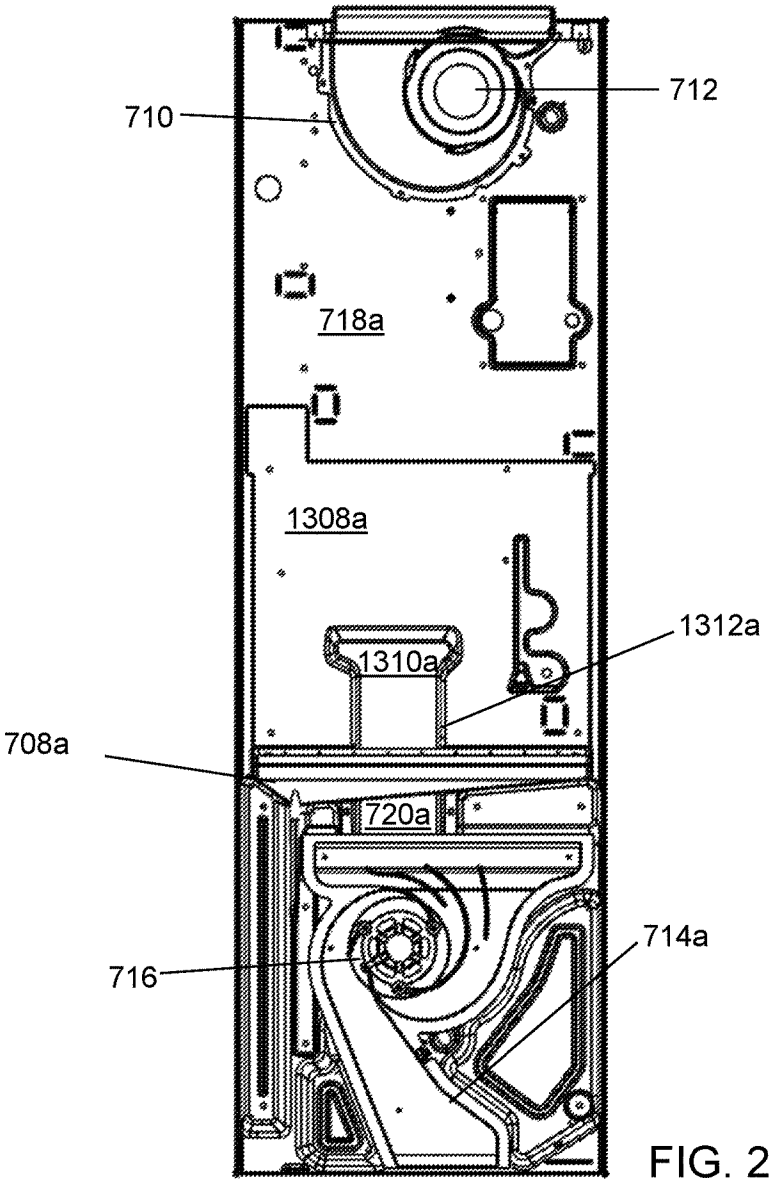
FIG. 29 depicts a front view of the air flow system of FIG. 28 with the evaporator and an evaporator back cover removed in accordance with an illustrative embodiment.
Figure 28:
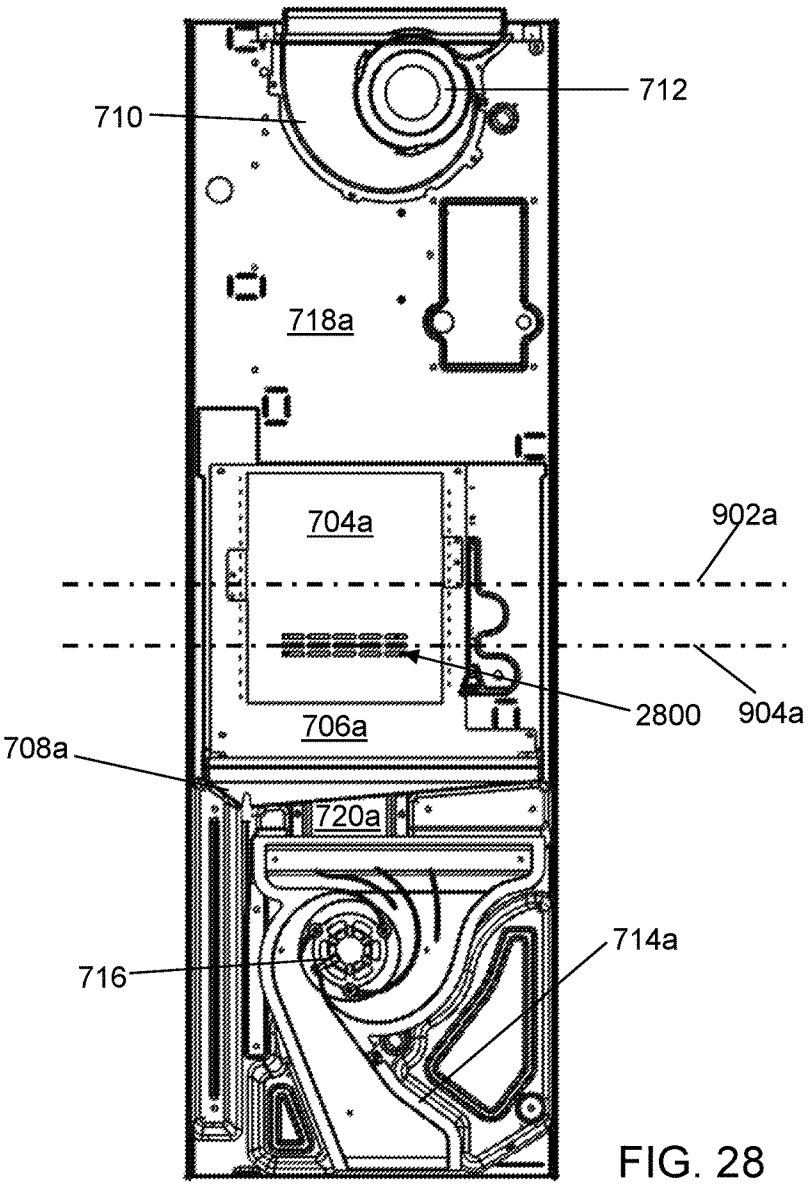
FIG. 28 depicts a front view of the air flow system of FIG. 27 with an evaporator transparent in accordance with an illustrative embodiment.

Referring to FIG. 24, a right, front, perspective view of second air flow system 2300 is shown in accordance with an illustrative embodiment. Referring to FIG. 25, a front view of second air flow system 2300 is shown in accordance with an illustrative embodiment. Referring to FIG. 26, a front view of second air flow system 2300 is shown with second top vent plate 304*a* and second bottom vent plate 400*a* removed in accordance with an illustrative embodiment. Referring to FIG. 27, a front view of second air flow system 2300 is shown with second top vent plate 304*a*, second bottom vent plate 400*a*, and second evaporator front cover plate 702*a* removed in accordance with an illustrative embodiment. Referring to FIG. 28, a front view of second air flow system 2300 is shown with second top vent plate 304*a*, second bottom vent plate 400*a*, and second evaporator front cover plate 702*a* removed and second evaporator 704*a* transparent in accordance with an illustrative embodiment. Referring to FIG. 29, a front view of second air flow system 2300 is shown with second top vent plate 304*a*, second bottom vent plate 400*a*, and second evaporator front cover plate 702*a*, second evaporator 704*a*, and second evaporator back cover plate 706*a* removed in accordance with an illustrative embodiment. Similar to cabinet 700, the first compartment includes a third zone 310*a* similar to first zone 310, and a fourth zone 312*a* similar to second zone 312.

A plurality of aperture walls 2800 is formed in second evaporator back cover 706*a* and positioned relative to second evaporator 704*a* to provide an aperture through which a portion of the cooled air from second evaporator 704*a* can be drawn based on operation of second fan 3730. For example, when second fan 3730 is in an "Off" state under control of refrigerator controller 3700, little or no cooled air flows through the plurality of aperture walls 2800 toward fourth zone 312*a*. A remainder or approximately all of the cooled air from second evaporator 704*a* can be drawn upwards toward first fan 3728 when first fan 3728 is operated to the "On" state by refrigerator controller 3700 depending on whether or not second fan 3730 is operated to the "On" state by refrigerator controller 3700.

In the illustrative embodiment, the plurality of aperture walls 2800 define three rows and five columns of apertures. A size and location of the plurality of aperture walls 2800 may be selected based on an amount of cooling needed for fourth zone 312*a* relative to third zone 310*a*. A second evaporator vertical center line 902*a* indicates a vertical center through second evaporator 704*a*. A second aperture vertical center line 904*a* indicates a vertical center through the plurality of aperture walls 2800. In the illustrative embodiment, second aperture vertical center line 904*a* is below second evaporator center line 902*a* though this is not required. Second aperture vertical center line 904*a*, for example, may be positioned at any vertical location above a lower edge of second evaporator 704*a* by at least 10% of the height of second evaporator 704*a* or below an upper edge of second evaporator 704*a* by at least 10% of the height of second evaporator 704*a* such that only a portion of the cooled air is withdrawn from second evaporator 704*a* when second fan 3730 is on.

The plurality of aperture walls 2800 are also centered about a horizontal center (not shown) of second evaporator 704*a* though this is not required. At the selected second aperture vertical center line 904*a*, the plurality of aperture walls 2800 may extend partially across a width of second evaporator 704*a* as shown in FIG. 28.

In the illustrative embodiment, a size of each aperture was selected because it was a standard punch size. A quantity and location were determined based on how much air from which portion of second evaporator 704*a* was needed to keep second evaporator 704*a* at a warmer temperature when only fourth zone 312*a* is cooling. For example, a single slot located near the horizontal center may result in second evaporator 704*a* becoming too cold. Because second evaporator 704*a* may be operating at a colder temperature, first fan 3728 and/or second fan 3730 may run for a longer time during a defrost assist mode of operation increasing the energy used and potentially adding too much humidity back into cabinet 700. By creating a grid pattern of slots across a width of second evaporator 704*a* and locating them closer to an inlet of second evaporator 704*a*, an overall evaporator temperature was increased when only fourth zone 312*a* is cooling and a defrost assist time was reduced.

Figure 31:
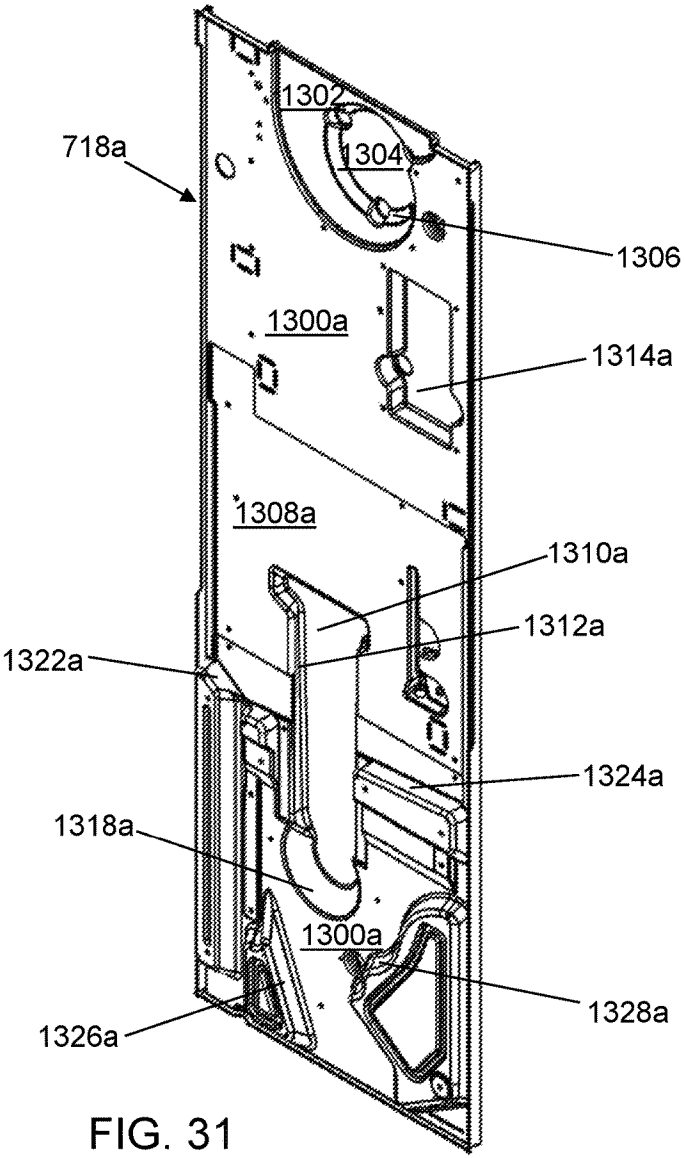
FIG. 31 depicts a right, front, perspective view of the back liner of FIG. 30 in accordance with an illustrative embodiment.
Figure 30:
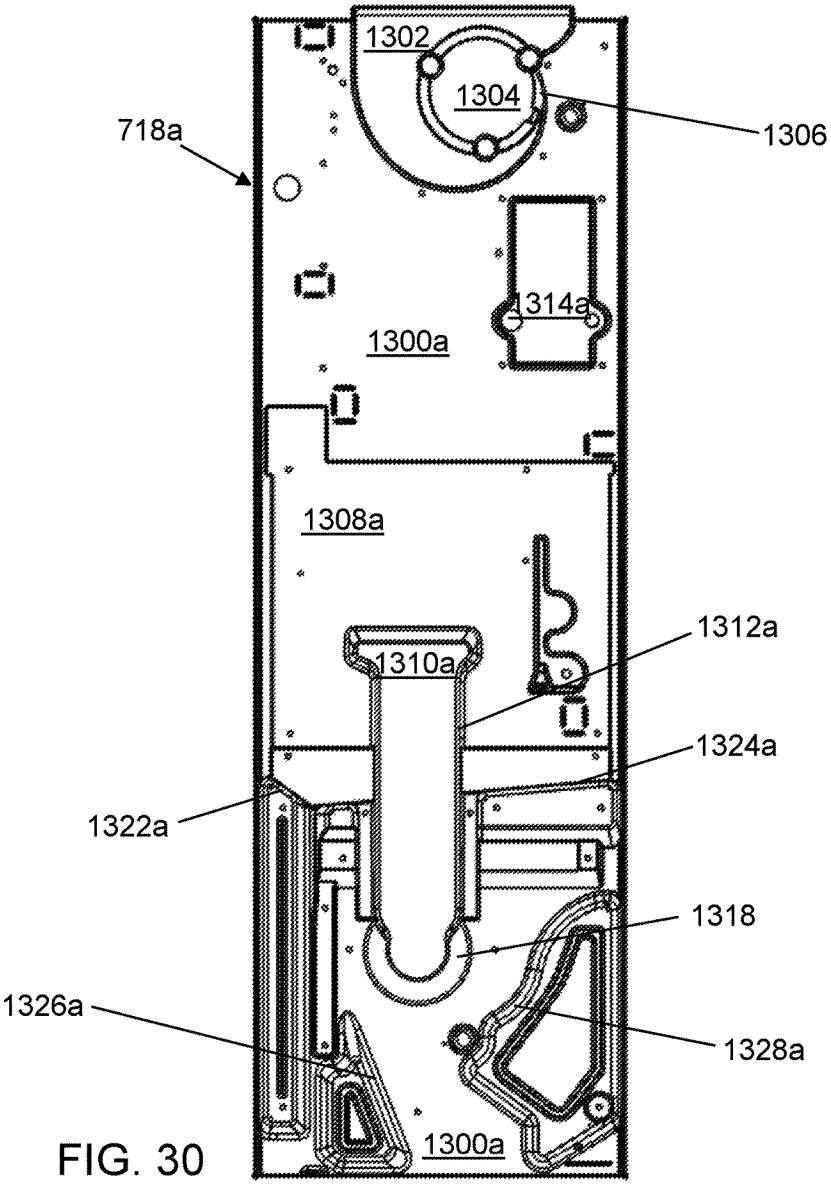
FIG. 30 depicts a front view of a back liner of the air flow system of FIG. 28 in accordance with an illustrative embodiment.

Referring to FIG. 30, a front view of second back liner 718*a* is shown in accordance with an illustrative embodiment. Referring to FIG. 31, a right, front, perspective view of second back liner 718*a* is shown in accordance with an illustrative embodiment. Second back liner 718*a* may include a second plate 1300*a* that is generally flat but includes various depressions and protrusions formed therein or thereon to provide a mounting location for components of second air flow system 800*a* and to provide duct walls to supply air to first fan 3728 and/or second fan 3730. For example, second back liner 718*a* may include first fan shroud depression 1302, first fan housing depression 1304, first fan housing wall 1306, a second evaporator depression 1308*a*, a fourth zone duct depression 1310*a*, a fourth zone duct wall 1312*a*, a second air filter depression 1314*a*, second fan housing wall 1318, a third drain shelf wall 1322*a*, a fourth drain shelf wall 1324*a*, a third shroud shelf wall 1326*a*, and a fourth shroud shelf wall 1328*a*.

Third shroud shelf wall 1326*a* and fourth shroud shelf wall 1328*a* are walls of protrusions from second plate 1300*a* that act as a guide and a support for mounting third fan shroud 714*a* to second back liner 718*a*. The air filter fits within the walls that define second air filter depression 1314*a*. Third drain shelf wall 1322*a* and fourth drain shelf wall 1324*a* are protrusions from second plate 1300*a* that act as a guide and a support for mounting second drain trough 708*a* to second back liner 718*a*. Various fasteners and fastening methods may be used to mount third fan shroud 714*a* and second drain trough 708*a* to second back liner 718*a*.

Second evaporator 704*a* fits within the walls that define second evaporator depression 1308*a* that act as a guide and a support for mounting second evaporator 704*a* to second back liner 718*a*. Various fasteners and fastening methods may be used to mount second evaporator 704*a* to second back liner 718*a*.

Fourth zone duct depression 1310*a* defined by fourth zone duct wall 1312*a* formed in second plate 1300*a* defines an air duct for air flow from second evaporator 704*a* through the plurality of aperture walls 2800 to second fan 3730. A top portion of fourth zone duct wall 1312*a* is aligned with the plurality of aperture walls 2800 to define an entry point for the air from second evaporator 704*a*. The top portion of fourth zone duct wall 1312*a* may also funnel air toward a channel portion that is approximately the width of second fan housing wall 1318*a*.

Second back liner 718*a* may have variously shaped protrusions and depressions based on an arrangement and shape of the components of second air flow system 800*a* that mount to second back liner 718*a*. The described components can be arranged in other orientations based on their relative location. For example, the described vertical direction may be a horizontal direction in an alternative embodiment, and/or may be positioned on or near a left-side or a right-side of second evaporator 704*a*.

Figure 32:
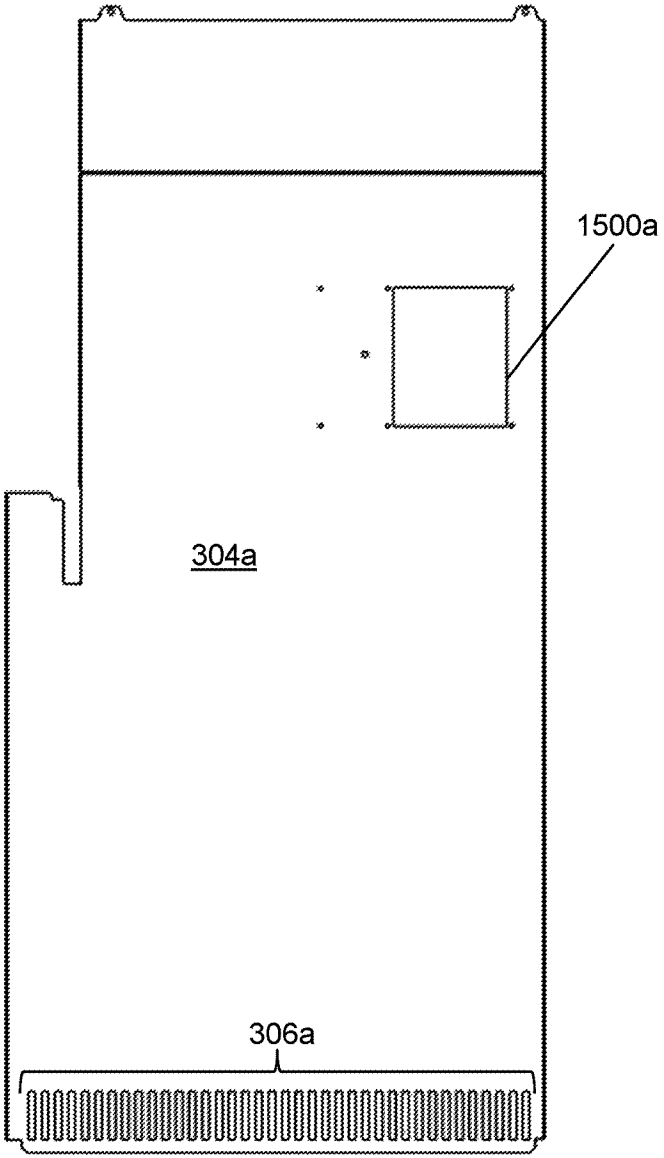
FIG. 32 depicts a right, front, perspective view of a top vent plate of the air flow system of FIG. 28 in accordance with an illustrative embodiment.

Referring to FIG. 32, a right, front, perspective view of second top vent plate 304*a* is shown in accordance with an illustrative embodiment. Second top vent plate 304*a* may further include a second air purifier aperture wall 1500*a* formed therethrough. Second air purifier cover plate 308*a* may cover the opening defined by second air purifier aperture wall 1500*a* that provides access to the air filter mounted in second air filter depression 1314*a*.

Figure 33:
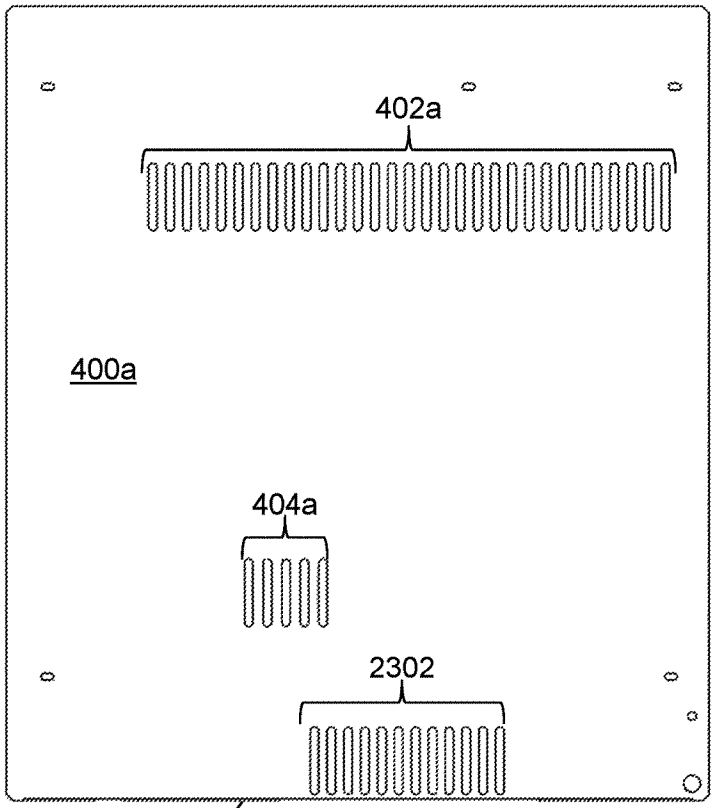
FIG. 33 depicts a right, front, perspective view of a bottom vent plate of the air flow system of FIG. 28 in accordance with an illustrative embodiment.

Referring to FIG. 33, a right, front, perspective view of second bottom vent plate 400*a* is shown in accordance with an illustrative embodiment. The fourth zone bottom plurality of vents 2302 are positioned just above a second bottom edge 1602*a* of second bottom vent plate 400*a* to provide cooled air to bottom wall 110 below drawer stack 300. Fourth zone top plurality of vents 402*a*, fourth zone middle plurality of vents 404*a*, and fourth zone bottom plurality of vents 2302 are positioned, sized, and shaped to provide cooled air behind and below drawer stack 300 of fourth zone 312*a*. In the illustrative embodiment, fourth zone top plurality of vents 402*a* are arranged to blow air between first drawer 500 and second drawer 502; fourth zone middle plurality of vents 404*a* are arranged to blow air between third drawer 504 and fourth drawer 506; fourth zone bottom plurality of vents 2302 are arranged to blow air below fourth drawer 506. To achieve the goal of 1 degree of temperature stratification for all four drawers, more slots were needed near a top of drawer stack 300. The location of fourth zone top plurality of vents 402*a*, fourth zone middle plurality of vents 404*a*, and fourth zone bottom plurality of vents 2302 is further selected in combination with a shape of second back liner 718*a* relative to second fan 3730.

Figure 34:
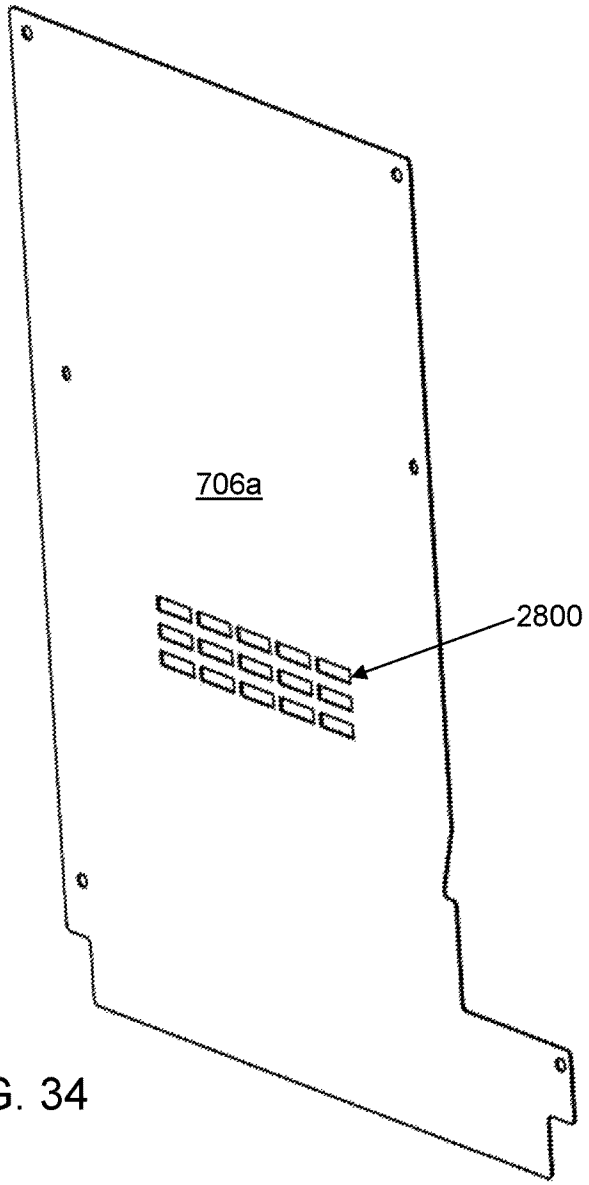
FIG. 34 depicts a right, front, perspective view of an evaporator back cover of the air flow system of FIG. 28 in accordance with an illustrative embodiment.

Referring to FIG. 34, a right, front, perspective view of second evaporator back cover 706*a* is shown in accordance with an illustrative embodiment. Second evaporator back cover 706*a* blocks a flow of air from second evaporator 704*a* to fourth zone duct depression 1310*a* except through the plurality of aperture walls 2800 so that a remainder of air flows upward toward first fan 3728 when first fan 3728 is on. Second evaporator back cover 706*a* and second lower duct cover plate 720*a* are mounted over fourth zone duct depression 1310*a* to form an enclosure that keeps air from escaping fourth zone duct depression 1310*a* before it reaches second fan 3730. When neither first fan 3728 or second fan 3730 are on, the air within third zone 310*a* and fourth zone 312*a* is generally stagnate and moves based on opening or closing of right door 102*a* and on the laws of thermodynamics such that warmer air tends to move upwards. The plurality of aperture walls 2800 are adjacent a center of second evaporator 704*a* because second fan 3730 is positioned below a center of second evaporator 704*a*.

Figure 35:
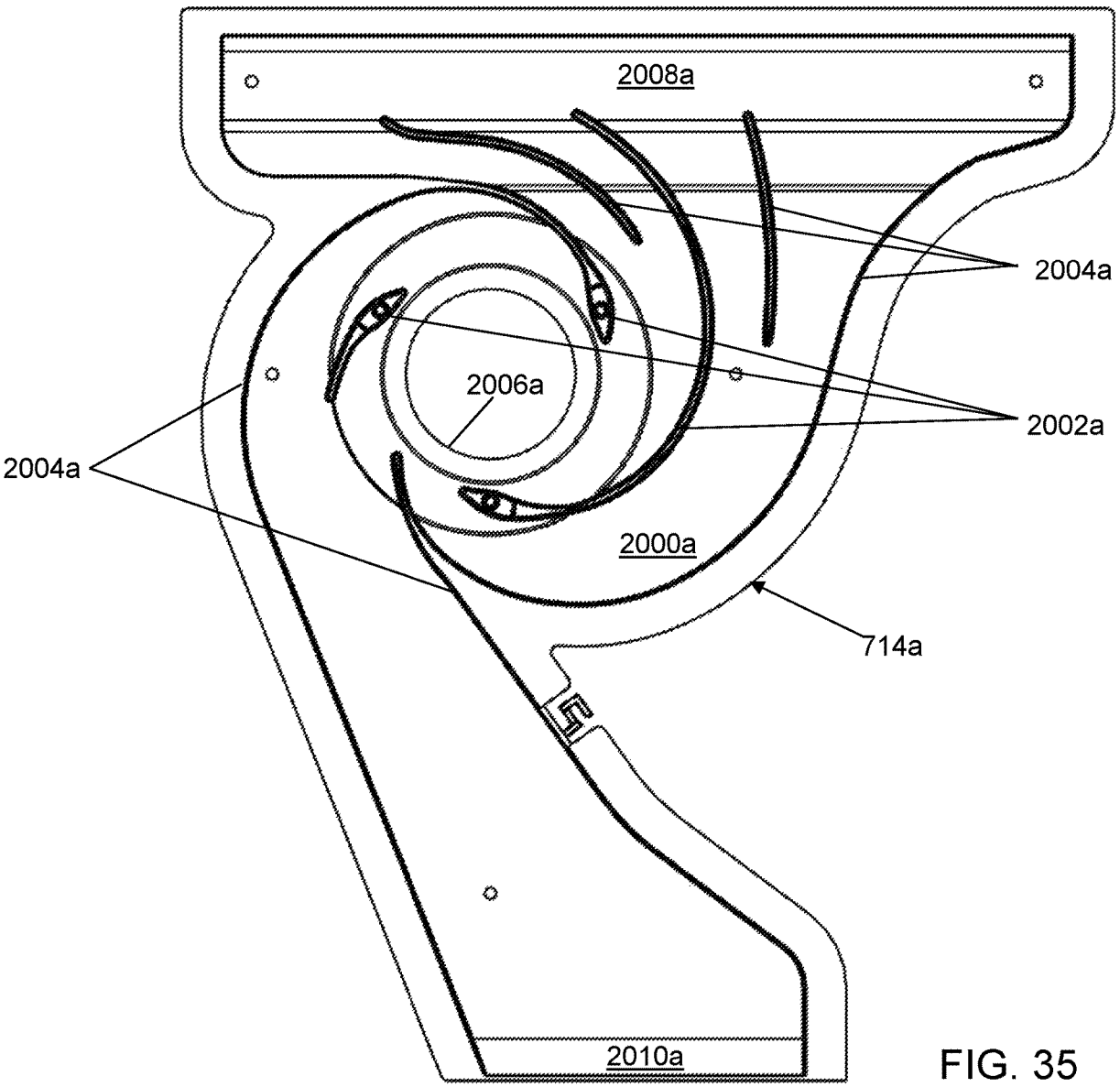
FIG. 35 depicts a front view of a third shroud of the air flow system of FIG. 28 in accordance with an illustrative embodiment.
Figure 36:
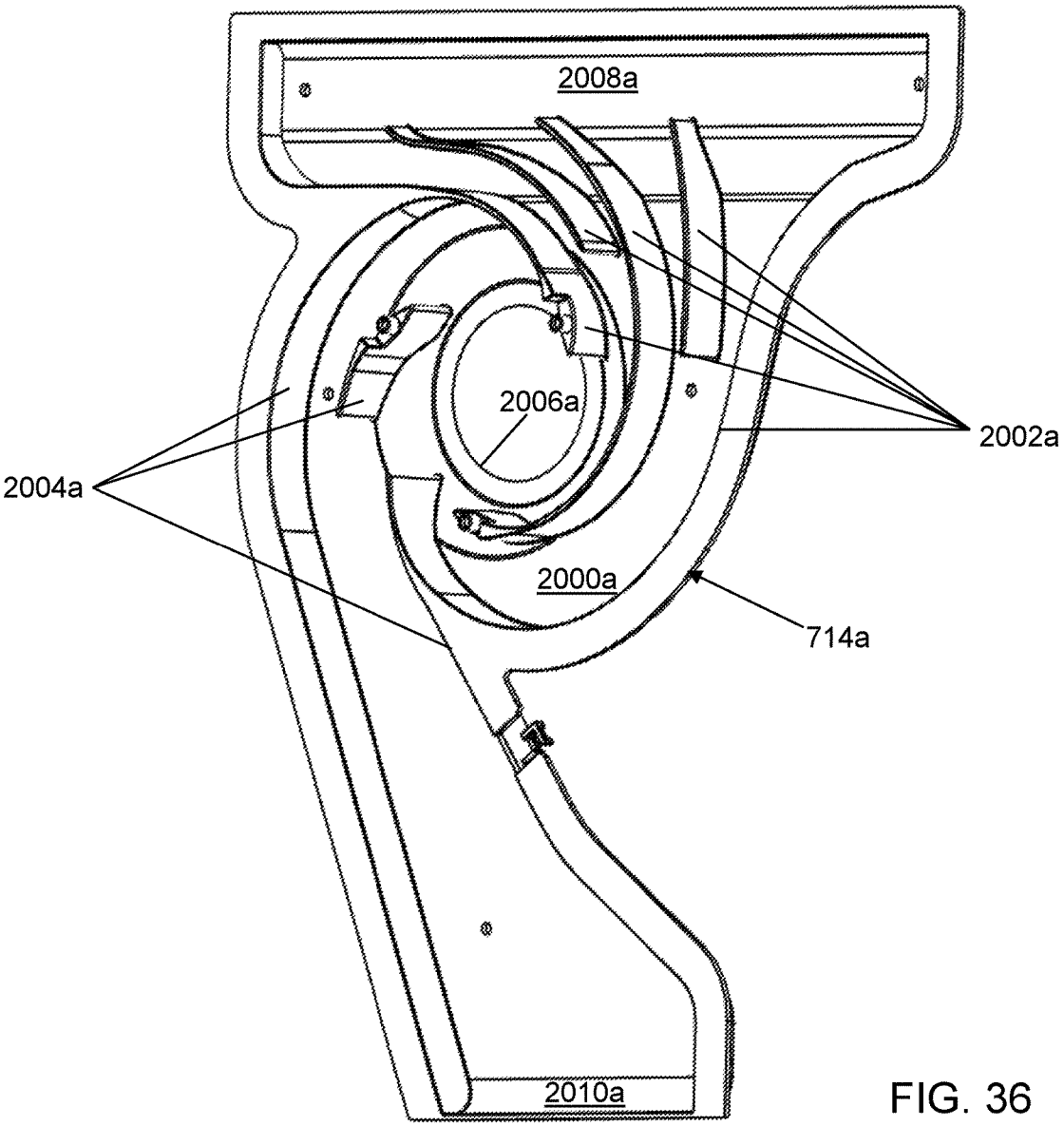
FIG. 36 depicts a right, front, perspective view of the third shroud of FIG. 35 in accordance with an illustrative embodiment.

Referring to FIG. 35, a front view of third shroud 714*a* is shown in accordance with an illustrative embodiment. Referring to FIG. 36, a right, front, perspective view of third shroud 714*a* is shown in accordance with an illustrative embodiment. In the illustrative embodiment, third shroud 714*a* includes a third shroud base plate 2000*a*, a first plurality of third shroud vanes 2002*a*, a second plurality of third shroud vanes 2004*a*, a third shroud fan aperture wall 2006*a*, a third air distribution plate 2008*a*, and a fourth air distribution plate 2010*a*. Second fan 3730 is centered in third shroud fan aperture wall 2006*a*.

The first plurality of third shroud vanes 2002*a* and the second plurality of third shroud vanes 2004*a* extend outward from third shroud base plate 2000*a* that is generally flat. The first plurality of third shroud vanes 2002*a* and the second plurality of third shroud vanes 2004*a* are shaped to direct air from second fan 3730 such that a first portion of the air exits along third air distribution plate 2008*a* through fourth zone top plurality of vents 402*a* and a second portion of the air exits along fourth air distribution plate 2010*a* through fourth zone middle plurality of vents 404*a*. The air that does not exit through fourth zone middle plurality of vents 404*a* flows further downward along second plate 1300*a* to exit through fourth zone bottom plurality of vents 2302.

In the illustrative embodiment, the first plurality of third shroud vanes 2002*a* include three curved walls that are equally dispersed circumferentially around third shroud fan aperture wall 2006*a*, which is circular in shape, to provide relatively equal distribution of the air that exits second fan 3730. The air is split such that approximately half of the air exits along third air distribution plate 2008*a* and the remainder of the air exits along fourth air distribution plate 2010*a*. The second plurality of third shroud vanes 2004*a* include two interior routing walls and three exterior routing walls.

Operation of second fan 3730 pulls air through the plurality of aperture walls 2800 down to be dispersed by third shroud 714*a* around drawer stack 300. The dispersed air is pulled through the second plurality of intake vents 306*a* toward second evaporator 704*a* that cools the air again. Operation of first fan 3728 pulls cooled air up from second evaporator 704*a* outward and down into third zone 310*a*. The dispersed air is also pulled through the second plurality of intake vents 306*a* toward second evaporator 704*a*.

Refrigerator controller 3700 controls a flow of refrigerant through each refrigeration system of refrigerator 100 or second refrigerator 100*a* where a refrigeration system cools air provided to one or more compartments. Refrigerator 100 and second refrigerator 100*a* may include one or more refrigeration systems. For illustration, a first refrigeration system may include first compressor 3736, a condenser (not shown), an expansion valve (not shown), a dryer (not shown), evaporator 704 or second evaporator 704*a* through which the refrigerant flows as well as various motors that control operation of the first refrigeration system components. For illustration, a second refrigeration system may include second compressor 3738, a second condenser (not shown), a second expansion valve (not shown), a second dryer (not shown), and a third evaporator (not shown) through which the refrigerant flows as well as various motors that control operation of the second refrigeration system components. The first refrigeration system may cool cabinet 700 or the first compartment of second refrigerator 100*a* while the second refrigeration system may cool the second compartment of second refrigerator 100*a* in an illustrative embodiment.

An air circulation system may include a fan, an air duct, and/or a return duct to provide cooled air from the associated evaporator to the zone/compartment and to return air from the zone/compartment to the associated evaporator to maintain the air in the zone at the temperature selected using the associated temperature control. Two or more zones/compartments may share portions of a refrigeration system and an air circulation system. The refrigeration system and air circulation system components may be mounted to various walls of refrigerator 100 or second refrigerator 100*a* either within the walls, on an exterior of the walls, and/or on an interior of the walls.

The position and orientation of various components of refrigerator 100 and second refrigerator 100*a* may be moved and/or reoriented based on the arrangement of the one or more compartments and the one or more cooling zones within each compartment. Additionally, various components may be mounted in different walls instead of mounted in the same wall that in the illustrative embodiments is back wall 112. The vent aperture walls may have other shapes and sizes than those shown and may be arranged in a fewer or a greater number of rows and columns.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled such that the compartment access structure(s) define a front of refrigerator 100.

As used in this disclosure, the term "mount" is intended to define a structural connection between two or more elements and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the elements referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

Referring to FIG. 37, a block diagram of refrigerator controller 3700 is shown in accordance with an illustrative embodiment. Refrigerator controller 3700 may include an input interface 3702, an output interface 3704, a communication interface 3706, a non-transitory computer-readable medium 3708, a processor 3710, a control application 3712, and control data 3714. Fewer, different, and/or additional components may be incorporated into refrigerator controller 3700.

Input interface 3702 provides an interface for receiving information from a user or another device for entry into refrigerator controller 3700 as understood by those skilled in the art. Input interface 3702 may interface with various input technologies including, but not limited to, first temperature sensor 3716, first temperature control 3718, second temperature sensor 3720, second temperature control 3722, third temperature sensor 3724, third temperature control 3726, etc. For example, each temperature sensor may produce a sensor signal value referred to as a measured temperature value representative of a measure of the temperature in an environment to which the temperature sensor is associated. Refrigerator 100 may include various numbers of and types of sensors that measure quantities associated with the operating environment of refrigerator 100 and its various compartments. Example additional sensor types include a pressure sensor, a temperature sensor, a fluid flow rate sensor, a voltage sensor, a current sensor, a frequency sensor, a humidity sensor, an acoustic sensor, a light sensor, a motion sensor, that may be mounted to various components of refrigerator 100 and/or second refrigerator 100*a*.

Input interface 3702 may further interface with various user input technologies including, but not limited to, a keyboard, a microphone, a mouse, a display, a track ball, a keypad, one or more buttons, one or more switches, one or more knobs, etc. to allow the user to enter information into refrigerator 100 and/or second refrigerator 100*a* or to make selections presented in a user interface displayed on the display. The same interface may support both input interface 3702 and output interface 3704. For example, the display comprising a touch screen provides a mechanism for user input and for presentation of output to the user. For illustration, first temperature control 3718, second temperature control 3722, and/or third temperature control 3726 may be provided in the display as user interface elements that allow the user to define a temperature set value for a respective zone/compartment enclosed within refrigerator 100 and/or second refrigerator 100*a*. The input interface technology further may be accessible by refrigerator controller 3700 through communication interface 3706.

Output interface 3704 provides an interface for outputting information for review by a user of refrigerator controller 3700 and/or for use by another application or device. For example, output interface 3704 may interface with various output technologies including, but not limited to, first fan 3728, second fan 3730, a third fan 3732, refrigerant control 3734, first compressor 3736, second compressor 3738, the display, a speaker, etc. For example, the microphone and the speaker may provide voice control and output to the user. Refrigerator controller 3700 may have one or more output interfaces that use the same or a different output interface technology. The output interface technology further may be accessible by refrigerator controller 3700 through communication interface 3706.

Communication interface 3706 provides an interface for receiving and transmitting data between devices using various protocols, transmission technologies, and media as understood by those skilled in the art. Communication interface 3706 may support communication using various transmission media that may be wired and/or wireless. Refrigerator controller 3700 may have one or more communication interfaces that use the same or a different communication interface technology. For example, refrigerator controller 3700 may support communication using an Ethernet port, a Bluetooth antenna, a telephone jack, a USB port, etc. Data and messages may be transferred between refrigerator controller 3700 and another device using communication interface 3706. For illustration, a smart phone may send a temperature set value to refrigerator controller 3700 and/or or receive a current temperature from refrigerator controller 3700.

Computer-readable medium 3708 is an electronic holding place or storage for information so the information can be accessed by processor 3710 as understood by those skilled in the art. Computer-readable medium 3708 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disc (CD), digital versatile disc (DVD), . . . ), smart cards, flash memory devices, etc. Refrigerator controller 3700 may have one or more computer-readable media that use the same or a different memory media technology. For example, computer-readable medium 3708 may include different types of computer-readable media that may be organized hierarchically to provide efficient access to the data stored therein as understood by a person of skill in the art. As an example, a cache may be implemented in a smaller, faster memory that stores copies of data from the most frequently/recently accessed main memory locations to reduce an access latency. Refrigerator controller 3700 also may have one or more drives that support the loading of a memory media such as a CD, DVD, an external hard drive, etc. One or more external hard drives further may be connected to refrigerator controller 3700 using communication interface 3706.

Processor 3710 executes instructions as understood by those skilled in the art. The instructions may be carried out by a special purpose computer, logic circuits, or hardware circuits. Processor 3710 may be implemented in hardware and/or firmware. Processor 3710 executes an instruction, meaning it performs/controls the operations called for by that instruction. The term "execution" is the process of running an application or the carrying out of the operation called for by an instruction. The instructions may be written using one or more programming language, scripting language, assembly language, etc. Processor 3710 operably couples with input interface 3702, with output interface 3704, with communication interface 3706, and with computer-readable medium 3708 to receive, to send, and to process information. Processor 3710 may retrieve a set of instructions from a permanent memory device and copy the instructions in an executable form to a temporary memory device that is generally some form of RAM. Refrigerator controller 3700 may include a plurality of processors that use the same or a different processing technology.

Control application 3712 performs operations associated with controlling the operation of refrigerator 100 or second refrigerator 100*a* to cool the various zones/compartments to the selected temperature using data stored in control data 3714, first temperature control 3718, second temperature control 3722, third temperature control 3726, sensor measurements, first fan 3728, second fan 3730, third fan 3732, first compressor 3736, second compressor 3738, etc. The operations may be implemented using hardware, firmware, software, or any combination of these methods. Referring to the example embodiment of FIG. 37, control application 3712 is implemented in software (comprised of computer-readable and/or computer-executable instructions) stored in computer-readable medium 3708 and accessible by processor 3710 for execution of the instructions that embody the operations of control application 3712. Control application 3712 may be written using one or more programming languages, assembly languages, scripting languages, etc.

Figure 38:
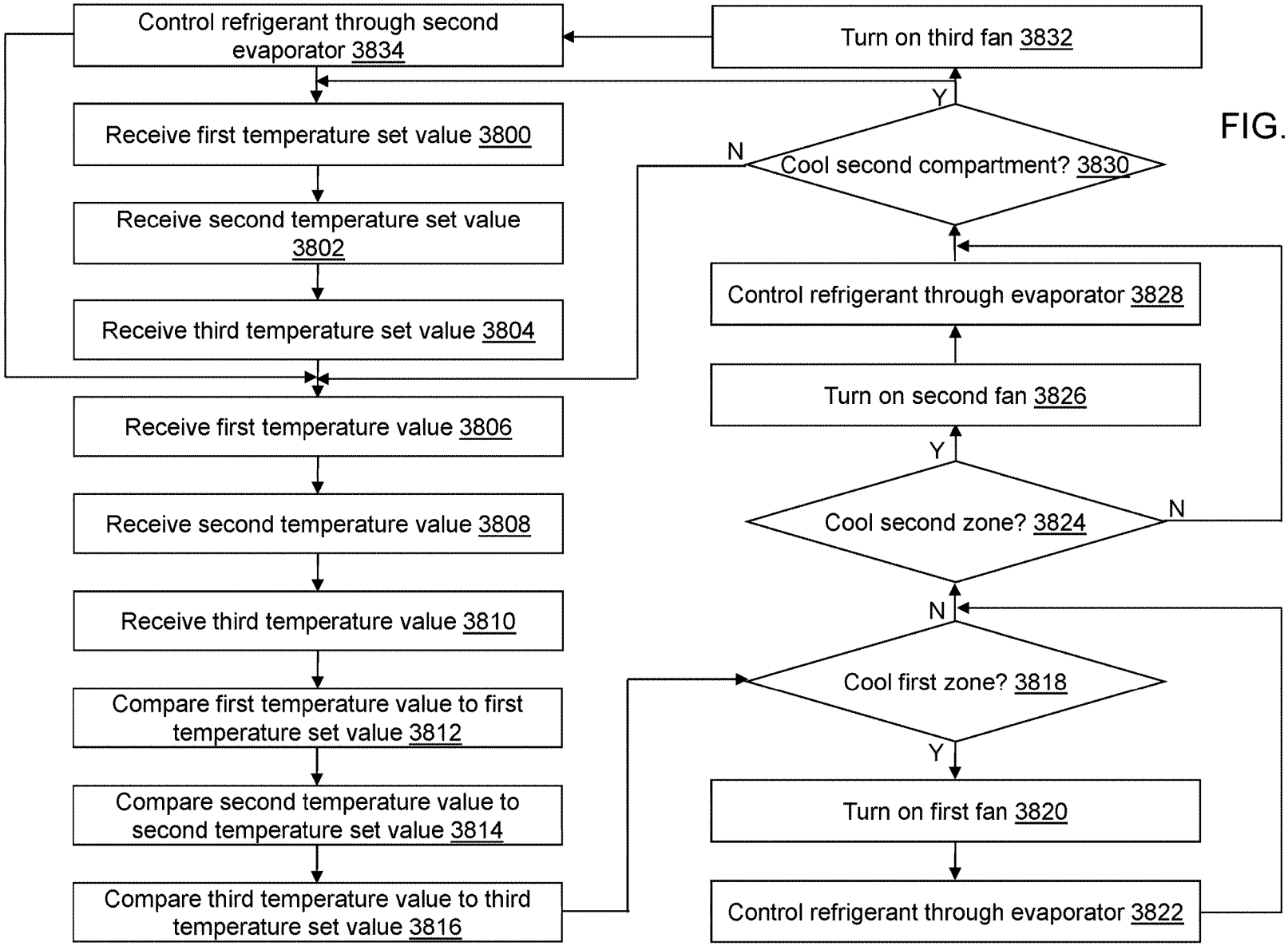
FIG. 38 depicts a flow diagram illustrating examples of operations performed by the refrigerator controller of FIG. 37 in accordance with an illustrative embodiment.

Referring to FIG. 38, example operations associated with control application 3712 are described. Additional, fewer, or different operations may be performed depending on the embodiment of control application 3712. The order of presentation of the operations of FIG. 38 is not intended to be limiting. Although some of the operational flows are presented in sequence, the various operations may be performed in various repetitions, concurrently (in parallel, for example, using threads), and/or in other orders than those that are illustrated. Control application 3712 may perform other operations, for example, associated with making ice, dispensing ice, turning on or off one or more lights, turning on or off a dryer based on a humidity level, detecting a door open or close, etc.

In an operation 3800, a first temperature set value may be received that indicates a desired temperature setting for first zone 310 or third zone 310*a*. For example, the first temperature set value may be received from first temperature control 3718 through input interface 3702 or communication interface 3706. The first temperature set value may be stored in control data 3714.

In an operation 3802, a second temperature set value may be received that indicates a desired temperature setting for second zone 312 or fourth zone 312*a*. For example, the second temperature set value may be received from second temperature control 3722 through input interface 3702 or communication interface 3706. The second temperature set value may be stored in control data 3714. In an illustrative embodiment, the first temperature set value may be separately controllable from 34° F. to 42° F., and the second temperature set value may be separately settable to +/−2° F. relative to the first temperature set value.

In an illustrative embodiment, where second zone 312 or fourth zone 312*a* include drawer stack 300, temperature depressed crisper drawers can be provided with a low risk of frozen drain troughs as well as the ability to lower a defrost assist exit temperature. A lower defrost assist exit temperature provides better temperature control at lower set points as well as a reduction in moisture build up.

In an operation 3804, a third temperature set value may be received that indicates a desired temperature setting for the second compartment. Though not shown, the second compartment may include one or more zones. The third temperature set value may be received from third temperature control 3726 through input interface 3702 or communication interface 3706. The third temperature set value may be stored in control data 3714.

In an operation 3806, a first temperature value may be received that indicates a current temperature in first zone 310 or third zone 310*a*. For example, the first temperature value may be received from first temperature sensor 3716 through input interface 3702 or communication interface 3706.

In an operation 3808, a second temperature value may be received that indicates a current temperature in second zone 312 or fourth zone 312*a*. For example, the second temperature value may be received from second temperature sensor 3720 through input interface 3702 or communication interface 3706.

In an operation 3810, a third temperature value may be received that indicates a current temperature in the second compartment. For example, the third temperature value may be received from third temperature sensor 3724 through input interface 3702 or communication interface 3706.

In an operation 3812, the first temperature value is compared to the first temperature set value to determine if cooling is needed in first zone 310 or third zone 310*a*.

In an operation 3814, the second temperature value is compared to the second temperature set value to determine if cooling is needed in second zone 312 or fourth zone 312*a*.

In an operation 3816, the third temperature value is compared to the third temperature set value to determine if cooling is needed in the second compartment.

In an operation 3818, a determination is made concerning whether or not cooling is needed in first zone 310 or third zone 310*a* based on the comparison in operation 3812. When cooling is needed in first zone 310 or third zone 310*a*, processing continues in an operation 3820. When cooling is not needed in first zone 310 or third zone 310*a*, processing continues in an operation 3824.

In operation 3820, first fan 3728 is turned on to circulate cooled air into first zone 310 or third zone 310*a*.

In an operation 3822, a flow of refrigerant through evaporator 704 or second evaporator 704*a* is controlled to cool the air circulated into first zone 310 or third zone 310*a*.

In operation 3824, a determination is made concerning whether or not cooling is needed in second zone 312 or fourth zone 312*a* based on the comparison in operation 3814. When cooling is needed in second zone 312 or fourth zone 312*a*, processing continues in an operation 3826. When cooling is not needed in second zone 312 or fourth zone 312*a*, processing continues in an operation 3830.

In operation 3826, second fan 3730 is turned on to circulate air into second zone 312 or fourth zone 312*a*. Second fan 3730 draws air from evaporator 704 or second evaporator 704*a* through aperture wall 900 or the plurality of aperture walls 2800 into second zone 312 or fourth zone 312*a*, respectively.

In an operation 3828, a flow of refrigerant through evaporator 704 or second evaporator 704*a* is controlled to cool the air circulated into second zone 312 or fourth zone 312*a*. For example, first compressor 3736 and the condenser are connected to receive refrigerant from evaporator 704 or second evaporator 704*a* through operation of various valves and/or motors also under control of control application 3712. A first compressor speed and a second compressor speed for operating first compressor 3736 may be determined based on a cooling rate of a previous cooling cycle in an illustrative embodiment. When both first zone 310 and second zone 312 or both third zone 310*a* and fourth zone 312*a*, respectively, need cooling, a highest compressor speed may be selected from the determined first compressor speed and the determined second compressor speed. In an alternative embodiment, first compressor 3736 may not be operated by a variable speed motor and a single compressor speed is used regardless of whether either or both pairs of zones need cooling. The compressor speed(s) may be defined in control data 3714 optionally as a function of a temperature difference between a measured temperature value and a temperature set value. Due to each zone's ability to control first compressor 3736, refrigerator 100 and the first compartment of second refrigerator 100*a* differ from passive "shared air" systems where air is simply diverted from a colder zone to a warmer zone.

In operation 3830, a determination is made concerning whether or not cooling is needed in the second compartment based on the comparison in operation 3816. When cooling is needed in the second compartment, processing continues in an operation 3832. When cooling is not needed in the second compartment, processing continues in operation 3806.

In operation 3832, third fan 3732 is turned on to circulate air into the second compartment. Third fan 3732 draws air from the third evaporator into the second compartment.

In an operation 3834, a flow of refrigerant through the third evaporator is controlled to cool the air circulated into the second compartment.

Processing may continue in operation 3806 though a new temperature set value may be received at any time, which may trigger a repeat of any of operations 3800, 3802, or 3804.

Either or both of first fan 3728 and second fan 3730 may be operated to defrost evaporator 704 or second evaporator 704*a*. Any resulting condensation is received by drain trough 708 mounted below evaporator 704 and routed to an exterior of back wall 112 through drain port 118 or condensation is received by second drain trough 708*a* mounted below second evaporator 704*a* and routed to the exterior of back wall 112 through the drain port.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A refrigerator comprising:

an evaporator;

a refrigerator controller;

a compartment comprising a plurality of walls, wherein at least one of the plurality of walls is configured to be moved with respect to remaining walls of the plurality of walls to provide access to a cavity defined by the remaining walls;

a first temperature sensor configured to measure a first temperature value of air in a first zone within the compartment and to send the measured first temperature value to the refrigerator controller; and a second temperature sensor configured to measure a second temperature value of air in a second zone within the compartment and to send the measured second temperature value to the refrigerator controller;

a first fan;

a first duct mounted between the evaporator and the first fan, wherein the first fan is configured to receive air from the first duct and to move the received air into the first zone when on;

a second fan;

a second duct mounted between the evaporator and the second fan, the second duct comprising a duct wall that forms a first aperture and a second aperture, wherein the second fan is configured to receive second air from the evaporator through the second duct and to move the received second air into the second zone when on;

a return duct mounted at least partially between the first zone or the second zone and the evaporator; and a plate mounted between the evaporator and the second duct, wherein the plate is mounted on a first side of the evaporator between one of the remaining walls of the plurality of walls and the evaporator, wherein the first side is opposite a second side of the evaporator, wherein the second side is closer to the cavity than the first side, the plate comprising a plate aperture wall that defines a duct aperture formed through the plate, wherein the first aperture of the second duct is adjacent the second fan, wherein the second aperture of the second duct is positioned to encompass the duct aperture, wherein a center of the duct aperture is positioned a distance from a center of the evaporator measured in a first direction, wherein the distance is between 0% and 40% of a total length of the evaporator in the first direction.

2. The refrigerator of claim 1, wherein the refrigerator controller is configured to:

receive the sent first temperature value;

receive the sent second temperature value;

compare the received first temperature value to a first temperature set value defined for the first zone;

compare the received second temperature value to a second temperature set value defined for the second zone;

control a flow of refrigerant through a coil of the evaporator based on the comparison between the received first temperature value and the first temperature set value and based on the comparison between the received second temperature value and the second temperature set value;

control operation of the first fan based on the comparison between the received first temperature value and the first temperature set value; and control operation of the second fan based on the comparison between the received second temperature value and the second temperature set value.

3. The refrigerator of claim 2, further comprising:

a compressor connected to receive the refrigerant from the evaporator;

wherein the refrigerator controller is further configured to control operation of the compressor based on the comparison between the received first temperature value and the first temperature set value and based on the comparison between the received second temperature value and the second temperature set value.

4. The refrigerator of claim 3, wherein controlling operation of the compressor comprises:

determining a first compressor speed for the first zone;

determining a second compressor speed for the second zone; and selecting a highest compressor speed from the determined first compressor speed and the determined second compressor speed when both the first fan and the second fan are controlled on.

5. The refrigerator of claim 1, wherein the plate comprises a plurality of plate aperture walls that define a plurality of duct apertures formed through the plate, wherein the plate aperture wall is one of the plurality of plate aperture walls.

6. The refrigerator of claim 1, wherein the plate covers a portion of the second duct.

7. The refrigerator of claim 1, wherein the first zone is located above or below the second zone, and the first direction is a vertical direction.

8. The refrigerator of claim 1, wherein the first zone is located to the left or to the right of the second zone, and the first direction is a horizontal direction.

9. The refrigerator of claim 1, wherein the first duct and the return duct form a continuous duct defined by a common plurality of duct walls, wherein the evaporator is mounted within the continuous duct.

10. The refrigerator of claim 9, wherein the continuous duct is defined by a second plate mounted between the evaporator and the first zone, wherein the second plate is mounted on the second side of the evaporator opposite the plate, the second plate comprising a plurality of vent aperture walls that define a plurality of vents formed through the second plate, wherein the plurality of vents is positioned between the first zone and the return duct.

11. The refrigerator of claim 9, wherein the continuous duct is defined by a second plate mounted between the evaporator and the second zone, wherein the second plate is mounted on the second side of the evaporator opposite the plate, the second plate comprising a plurality of vent aperture walls that define a plurality of vents formed through the second plate, wherein the plurality of vents is positioned between the second zone and the return duct.

12. The refrigerator of claim 1, wherein a drawer is mounted in the second zone.

13. The refrigerator of claim 12, wherein the drawer is enclosed.

14. The refrigerator of claim 12, wherein a shelf is mounted between the drawer and the first zone, wherein the shelf extends between the remaining walls.

15. The refrigerator of claim 1, wherein the center of the duct aperture is positioned a second distance from the center of the evaporator measured in a second direction, wherein the second distance is between 0% and 40% of a total length of the evaporator in the second direction, wherein the first direction is perpendicular to the second direction.

16. The refrigerator of claim 1, further comprising:

a shroud comprising a shroud base plate;

a shroud fan aperture wall formed through the shroud base plate, wherein the second fan is mounted adjacent the shroud fan aperture wall; and a plurality of shroud vanes that extend outward from the shroud base plate and that are configured to disperse the received second air into the second zone.

17. The refrigerator of claim 16, wherein the plurality of shroud vanes is dispersed around the shroud fan aperture wall and shaped to direct a first portion of the received second air in a second direction projected into a vertical plane that includes a radial center of the second fan and to direct a second portion of the received second air in a third direction projected into the vertical plane, wherein an angle of the second direction differs from an angle of the third direction by at least 90 degrees.

18. The refrigerator of claim 17, further comprising a second plate mounted between the shroud and the second zone, the second plate comprising a first vent aperture wall formed through the second plate and a second vent aperture wall formed through the second plate, wherein the first vent aperture wall is positioned to receive the first portion of the received second air, and wherein the second vent aperture wall is positioned to receive the second portion of the received second air.

19. The refrigerator of claim 16, wherein the shroud fan aperture wall is horizontally and vertically aligned with the first aperture of the second duct.

20. The refrigerator of claim 1, wherein the second duct is formed as a depression in a liner wall mounted within a wall of the remaining walls.

* * * * *